US008210639B2

(12) United States Patent
Kanbe et al.

(10) Patent No.: US 8,210,639 B2
(45) Date of Patent: Jul. 3, 2012

(54) INK SUPPLY DEVICES

(75) Inventors: Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 228 days.

(21) Appl. No.: 12/729,229

(22) Filed: Mar. 22, 2010

(65) Prior Publication Data

US 2010/0245457 A1 Sep. 30, 2010

(30) Foreign Application Priority Data

Mar. 27, 2009 (JP) ..... 2009-080592

(51) Int. Cl.
*B41J 29/393* (2006.01)
*B41J 2/175* (2006.01)

(52) U.S. Cl. ..... 347/19; 347/86

(58) Field of Classification Search ..... 347/84–86, 347/5, 7, 19

See application file for complete search history.

(56) References Cited

U.S. PATENT DOCUMENTS 7,188,939 B1 3/2007 Sasaki
2004/0028517 A1* 2/2004 Lindquist ..... 414/792.7
2007/0048058 A1 3/2007 Koga et al.
2007/0229615 A1 10/2007 Hattori et al.
2008/0180498 A1 7/2008 Hattori et al.
2008/0291251 A1* 11/2008 Hattori ..... 347/86

FOREIGN PATENT DOCUMENTS

EP 1772270 A2 4/2007
EP 1792736 A1 6/2007
EP 1826009 A2 8/2007
EP 1839871 A1 10/2007
EP 1839873 A1 10/2007
JP 2005-288866 A 10/2005
JP 2007-090761 A 4/2007
JP 2008-246999 A 10/2008

OTHER PUBLICATIONS

European Patent Office; Search Report in European Patent Application No. 10153616.7 (counterpart to the related U.S. patent application) mailed Mar. 26, 2010.

* cited by examiner

*Primary Examiner* — Geoffrey Mruk
(74) *Attorney, Agent, or Firm* — Baker Botts L.L.P.

(57) ABSTRACT

An ink supply device includes a cartridge mounting portion to which an ink cartridge is configured to be mounted by being inserted thereinto in an insertion direction. The ink supply device further includes a controller configured to determine a type of the ink cartridge based on first determination information initially stored during an insertion of the ink cartridge into the cartridge mounting portion and second determination information finally stored during the insertion of the ink cartridge into the cartridge mounting portion.

12 Claims, 13 Drawing Sheets

INK SUPPLY DEVICES

CROSS-REFERENCE TO RELATED APPLICATION

The present application claims priority to and the benefit of Japanese Patent Application No. 2009-080592, which was filed on Mar. 27, 2009, the disclosure of which is incorporated herein by reference in its entirety.

BACKGROUND OF THE INVENTION

1. Field of the Invention

The present invention relates to an ink supply devices in which a controller is configured to determine a type of an ink cartridge based on a detector detecting a portion of the ink cartridge configured to be mounted to a cartridge mounting portion.

2. Description of Related Art

In a known ink jet printing apparatus such as an apparatus described in JP-A-2005-288866, an ink cartridge is positioned in the apparatus at a position outside a carriage on which the printhead is mounted, and the ink cartridge and the printhead are in fluid combination via a tube. The ink cartridge is configured to be removably mounted to a cartridge mounting portion by being inserted thereinto in a horizontal direction from the front side of the apparatus. When the ink cartridge is mounted to the cartridge mounting portion, an ink supply path from the ink cartridge to the printhead via the cartridge mounting portion is formed. Ink is supplied from the ink cartridge to the printhead through this ink supply path.

In another known ink-jet printing apparatus such as an apparatus described in JP-2008-246999, detectors such as optical detectors are provided in the cartridge mounting portion for determining the type of the ink cartridge, e.g., determining the color or initial amount of ink stored in the ink cartridge. The ink cartridge has detectable portions positioned corresponding to the detectors, for determining the color or initial amount of ink. When the ink cartridge is inserted into the cartridge mounting portion and the detectable portions are detected by the detectors, signals are output from the detectors, and a controller of the apparatus executes a process of determining the type of the ink cartridge based on the signals. In this apparatus, the type of the ink cartridge is determined among two types.

When a color image is recorded by an ink-jet printing apparatus, inks in a plurality of colors such as cyan, magenta, yellow, and black are used. The inks in the respective colors are stored in independent ink cartridges. The ink cartridges which store the inks in the respective colors are mounted to corresponding cartridge mounting portions. It is undesirable for the ink cartridges storing different color inks to be mixed up and to be used in wrong cartridge mounting portions. Moreover, there exist ink cartridges having different initial amount of ink stored therein and ink cartridges storing inks having different ink components such as dye or pigment. As such, the ink cartridges have a variety of the types. Therefore, in an ink-jet printing apparatus, the type of the ink cartridge needs to be determined among not only two types but also further variety of types.

However, the number of detectors may be increased for determining the type of an ink cartridge among a variety of types, which would lead to cost increase.

Moreover, when the ink cartridge is inserted into the cartridge mounting portion, a user may begins to insert the ink cartridge into the cartridge mounting portion and partially removes the ink cartridge before finally fully inserting the ink cartridge into the cartridge mounting portion. Even if the ink cartridge moves back and force in the cartridge mounting portion like this, it is desirable to determine the type of the ink cartridge correctly.

SUMMARY OF THE INVENTION

Therefore, a need has arisen for ink supply devices which overcome these and other shortcomings of the related art. A technical advantage of the present invention is that a type of an ink cartridge can be determined among a variety of types with a small number of detectors. Another independent technical advantage of the present invention is that a type of an ink cartridge can be determined correctly even if the ink cartridge moves back and force in a cartridge mounting portion. These technical advantages are independent of each other, and at least one of the technical advantages is achieved by the present invention.

According to an embodiment of the present invention, an ink supply device comprises a cartridge mounting portion to which an ink cartridge is configured to be mounted by being inserted thereinto in an insertion direction. The cartridge mounting portion comprises a first detector configured to detect a first portion of the ink cartridge and to output first detection information when the first detector detects the first portion of the ink cartridge, and a second detector configured to detect a second portion of the ink cartridge and to output second detection information when the second detector detects the second portion of the ink cartridge. The ink supply device also comprises a storing unit configured to store first determination information of whether or not the second detection information is output by the second detector when the first detector begins outputting the first detection information, and second determination information of whether or not the second detection information is output by the second detector when the first detector stops outputting the first detection information. The ink supply device further comprises a controller configured to determine a type of the ink cartridge based on the first determination information initially stored during an insertion of the ink cartridge into the cartridge mounting portion and the second determination information finally stored during the insertion of the ink cartridge into the cartridge mounting portion.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Figure 1:
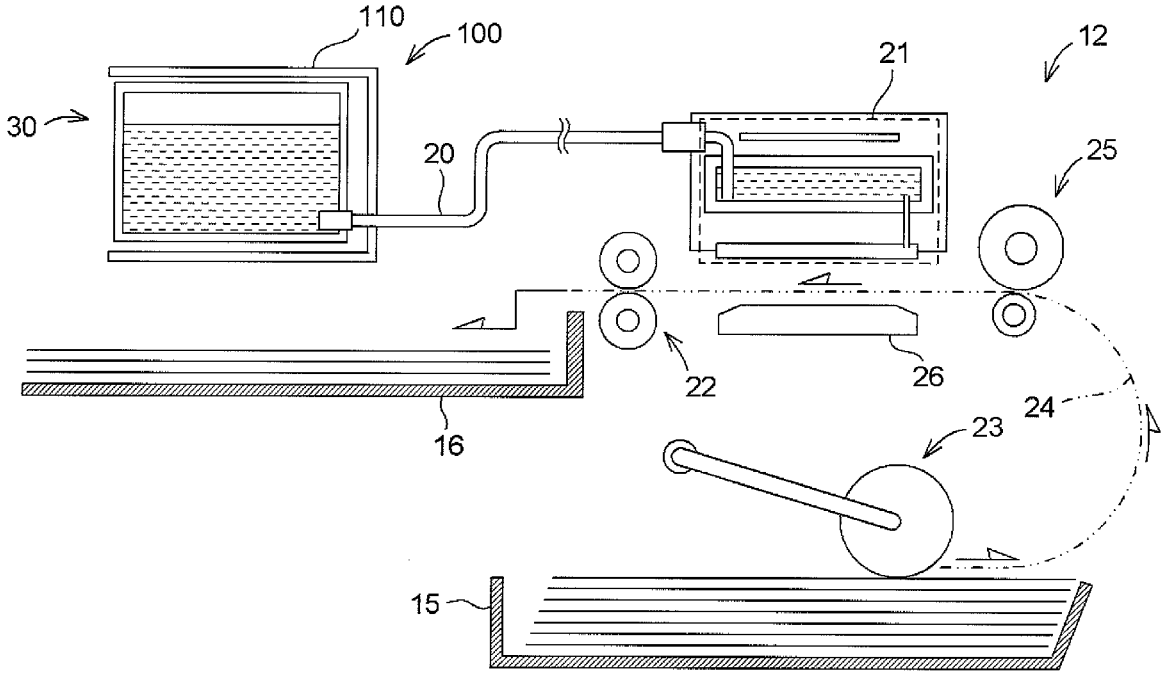
FIG. 1 is a schematic cross-sectional view of an internal structure of a printer according to an embodiment of the present invention.

Embodiments of the present invention, and their features and advantages, may be understood by referring to FIGS. 1-13, like numerals being used for like corresponding parts in the various drawings Referring to FIG. 1, a printer 12 is an ink jet printer configured to perform image printing on a recording medium such as a sheet of paper by selectively discharging inks in respective colors from a printhead 21 as minute ink droplets. Inks in respective colors are stored in ink cartridges 30, and the inks are supplied from ink cartridges 30 to the printer 12. More specifically, cyan (C) ink, magenta (M) ink, yellow (Y) ink, and black (BK) ink are stored in the ink cartridges 30, respectively. In other words, there are four types of ink cartridges 30 corresponding to the ink colors.

The ink cartridge 30 and the printhead 21 are in fluid communication via a flexible ink tube 20. There are four ink tubes 20 provided corresponding to the four ink colors, although not shown in detail in FIG. 1. The inks in the respective colors stored respectively in the ink cartridges 30 are supplied to the printhead 21 via the respective ink tubes 20.

Sheets of paper stacked in a paper feed tray 15 are fed to a conveying path 24 by a paper feed roller 23 one by one. In the conveying path 24, a conveying roller pair 25 transports the sheet of paper onto a platen 26. The printhead 21 prints an image on the sheet of paper by selectively discharging the respective color inks as the minute ink droplets onto the sheet of paper passing over the platen 26. An output roller pair 22 outputs the sheet of paper having passed over the platen 26 onto an output tray 16.

Printer 12 comprises an ink supply device 100 comprising the four types of the ink cartridges 30 and a cartridge holder 110. The four types of the ink cartridges 30 have the same structure except that the presence or absence of cut-outs 78, 79 formed in a type determinative portion 77 are different from one cartridge 30 to another, and hence one type of the ink cartridge 30 will be exemplified for the following description.

Figure 2A:
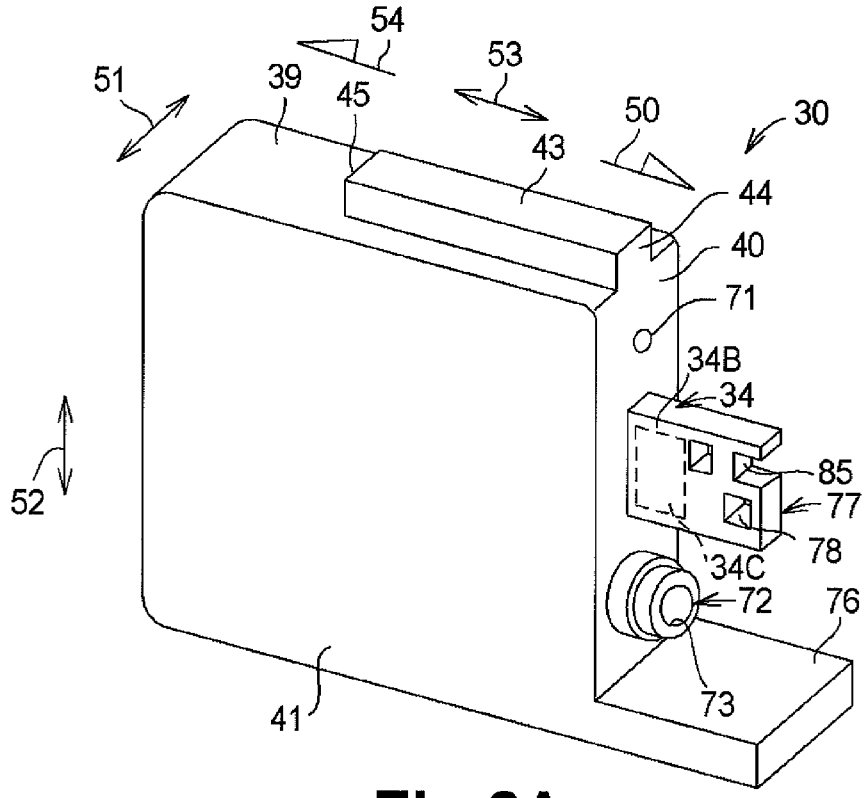
FIG. 2(A) is a perspective view of an ink cartridge according to an embodiment of the present invention.
Figure 2B:
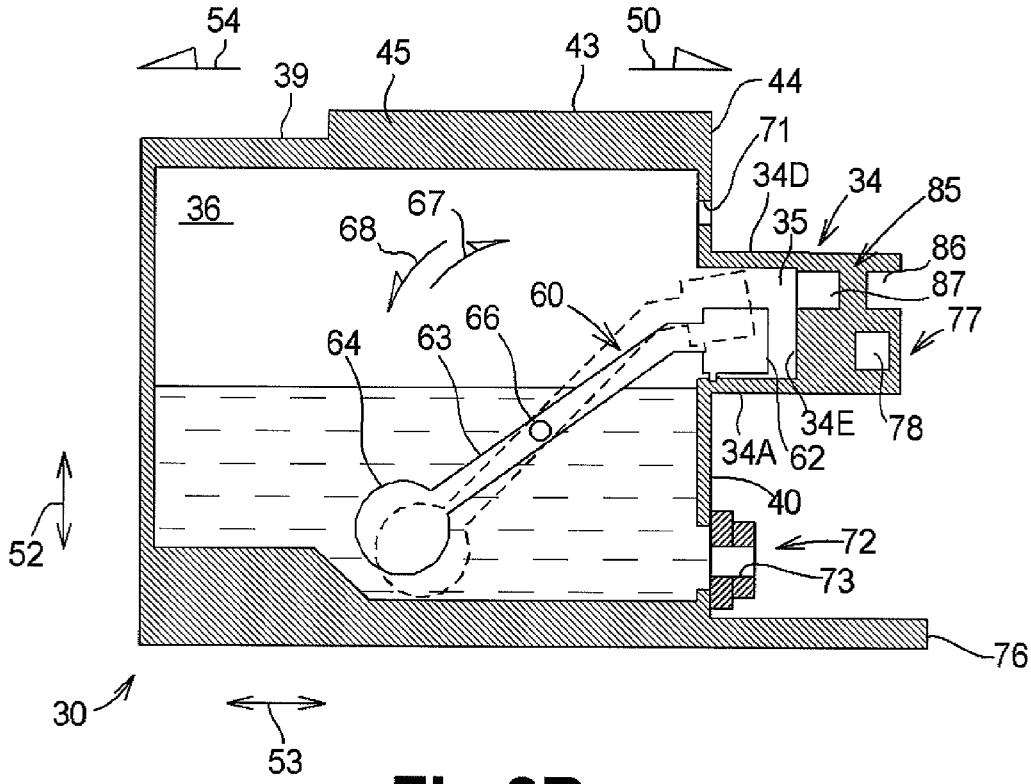
FIG. 2(B) is a vertical cross-sectional view of the ink cartridge.

Referring to FIGS. 2(A) and 2(B), the ink cartridge 30 has a container shape configured to store ink therein. More specifically, the ink cartridge 30 has a substantially rectangular parallelepiped shape. The ink cartridge 30 has a flat shape, such that a width dimension thereof in a width direction 51 is less than each of a height dimension thereof in a height direction 52 and a depth dimension thereof in a depth direction 53. The width direction 51, the height direction 52, and the depth direction 53 are perpendicular to each other. The ink cartridge 30 is inserted into the cartridge holder 110 in an insertion direction 50, which is parallel to the depth direction 53, and mounted to the cartridge holder 110 in the position (posture) shown in FIG. 2(A). The ink cartridge 30 comprises a front wall 40 facing forward with respect to the insertion direction 50. The front wall 40 comprises an air communication opening 71 formed therethrough, an ink amount detection portion 34, and an ink supply portion 72.

The ink cartridge 30 comprises an ink chamber 36 formed therein. The ink chambers 36 of the four ink cartridges 30 store Cyan ink, Magenta ink, Yellow ink, and Black ink, respectively.

The ink cartridge 30 is made of a translucent material, e.g., a transparent or semi-transparent material, so that light, e.g., visible or infrared light can pass through the ink cartridge 30. A projecting member 76 projects from the front wall 40 in the insertion direction 50.

The ink amount detection portion 34 is positioned above the ink supply portion 72 at the front wall 40. The amount of ink in the ink chamber 36 is visually or optically detected via the ink amount detection portion 34. The ink amount detection portion 34 is formed into a rectangular parallelepiped shape being thin in the width direction 51, and is formed integrally with the front wall 40. The ink amount detection portion 34 extends from the front wall 40 forward (rightward in FIG. 2(B)) in the insertion direction 50. More specifically, the ink amount detection portion 34 extends from a middle portion of the front wall 40 with respect to the height direction 52. The width of the ink amount detection portion 34 is less than the width of the front wall 40 in the width direction 51. The width of the ink amount detection portion 34 is set, such that the ink amount detection portion 34 can enter detection areas 115, 119 of optical detectors 114, 118 (see FIGS. 5(A) to 6). The ink amount detection portion 34 also is made of a translucent material, e.g., a transparent or semi-transparent material, so that light, e.g., visible or infrared light can pass through ink amount detection portion 34 in the width direction 51.

The ink amount detection portion 34 has an inner space 35 formed therein, and the inner space 35 is in fluid communication with the ink chamber 36. The inner space 35 is bounded by a bottom wall 34A, side walls 34B, an upper wall 34D, and a front wall 34E, which also constitute outer surfaces of the ink amount detection portion 34. The inner space 35 allows insertion of a light-blocking panel 62 of a detection arm 60 thereinto. In the ink amount detection portion 34, an irradiated portion 34C, which is a part of the side wall 34B, is irradiated with lights emitted from the optical detectors 114, 118, respectively.

The detection arm 60 is positioned in ink chamber 36. The detection arm 60 is configured to move according to the amount of ink stored in the ink chamber 36. The detection arm 60 comprises the light-blocking panel 62, an arm body 63, and a float 64. The detection arm 60 is able to pivot, such that light-blocking panel 62 moves between a lower position in which the light-blocking panel 62 contacts the bottom wall 34A of the ink amount detection portion 34, and an upper position in which the light-blocking panel 62 is separated from the bottom wall 34A and contacts the upper wall 34D according to the amount of ink stored in the ink chamber 36. In FIG. 2(B), the position of the detection arm 60 in which the light-blocking panel 62 contacts the bottom wall 34A is indicated by a solid line, and the position of the detection arm 60 in which the light-blocking panel 62 is separated from the bottom wall 34A is indicated by a broken line.

The arm body 63 is an elongated rod-shaped member, and is pivotaly supported by a supporting shaft 66 extending between both side walls 41 of the ink cartridge 30 in the width direction 51. The arm body 63 is configured to pivot in the ink chamber 36 in the directions indicated by an arrow 67 and an arrow 68, respectively, in FIG. 2(B).

The float 64 is provided at an end of the arm body 63 with respect to a removal direction 54 opposite the insertion direction 50. The float 64 has a hollow interior formed therein, and a predetermined buoyancy acts on the float 64 when the float 64 is submerged in ink. Therefore, the float 64 moves in the height direction 52 when the amount of ink stored in the ink chamber 36 increases or decreases. The detection arm 60 is configured to pivot when the float 64 moves. In another embodiment, the float 64 may not have a hollow interior therein, and a portion of the arm body 63 extending from the supporting shaft 66 to the float 64 and the float 64 may have the specific gravity less than the specific gravity of ink, such that a predetermined buoyancy acts thereon, or a portion of the portion of the arm body 63 extending from the supporting shaft 66 to the float 64 and the float 64 may have the specific gravity less than the specific gravity of ink, such that a predetermined buoyancy acts thereon.

The light-blocking panel 62 is provided at an end of the arm body 63 with respect to the insertion direction 50, i.e., at an end opposite from the float 64. When the ink amount in the ink chamber 36 is greater than or equal to a predetermined amount, the detection arm 60 is rotated clockwise, i.e., the direction indicated by the arrow 67, in FIG. 2(B) about the supporting shaft 66 because of the buoyancy acting on the float 64, and the light-blocking panel 62 moves downward in the inner space 35. Then, the light-blocking panel 62 comes into contact with the bottom wall 34A of the ink amount detection portion 34 and remains in the lower position (the position indicated by the solid line in FIG. 2(B)). When the ink amount in the ink chamber 36 is reduced to the predetermined amount, a part of the float 64 is exposed from the ink surface, and the buoyancy is balanced out by the gravity. When the ink amount in the ink chamber 36 is further reduced to an amount less than the predetermined amount, the float 64 moves down as the ink surface in the ink chamber 36 is lowered. When this occurs, the detection arm 60 is rotated counterclockwise i.e., the direction indicated by the arrow 68, in FIG. 2(B) about the supporting shaft 66, and the light-blocking panel 62 moves upward in the inner space 35 and moves apart from the bottom wall 34A. Then, the light-blocking panel 62 comes into contact with the upper wall 34D and remains in the upper position (the position indicated by the broken line in FIG. 2(B)).

The light-blocking panel 62 is aligned with a lower portion of the irradiated portion 34C in the width direction 51 when the light-blocking panel 62 is in the lower position. In contrast, when the light-blocking panel 62 is in the upper position, the light-blocking panel 62 is positioned above the lower portion of the irradiated portion 34C, and is not aligned with the lower portion of the irradiated portion 34C in the width direction 51.

The ink cartridge 30 comprises the type determinative portion 77 as an example of a second portion of the ink cartridge 30 and a triggering portion 85 as an example of a first portion of the ink cartridge 30. The type determinative portion 77 and the triggering portion 85 are formed integrally with the ink amount detection portion 34 at the front of the ink amount detection portion 34 with respect to the insertion direction 50. The type determinative portion 77 and the triggering portion 85 are arranged in two levels in the height direction 52 with the type determinative portion 77 positioned below the trigger portion 85.

Figure 5A:
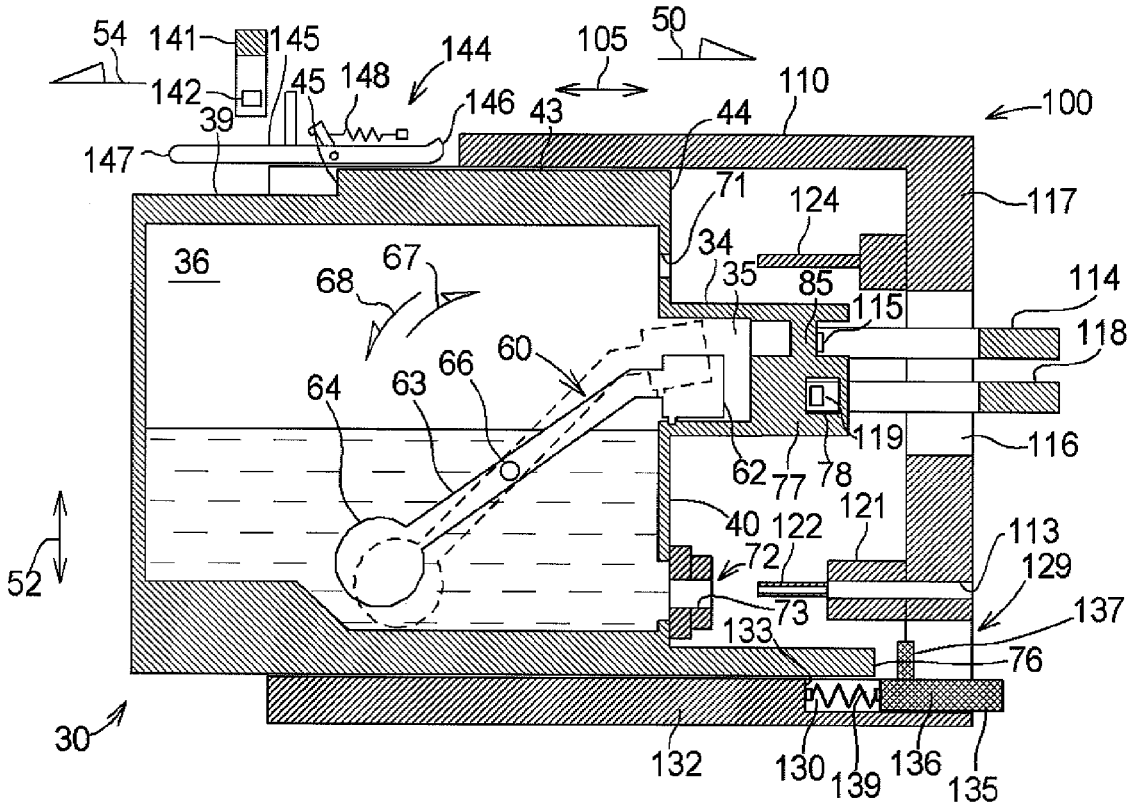
FIG. 5(A) is a vertical cross-sectional view of the ink cartridge of FIGS. 2(A) and 2(B) and the cartridge holder of FIGS. 3(A) and 3(B), in which the ink cartridge is inserted into the cartridge holder.

The type determinative portion 77 and the triggering portion 85 have a rectangular parallelepiped shape being thin in the width direction 51 similarly to the ink amount detection portion 34, and the width of the type determinative portion 77 and the triggering portion 85 in the width direction 51 is less than the width of the front wall 40, such that the triggering portion 85 and the type determinative portion 77 can enter the detection areas 115, 119 of the optical detectors 114, 118, respectively (see FIG. 5(A)). Each of the type determinative portion 77 and the triggering portion 85 are made of an opaque material which does not allow light, e.g., visible or infrared light to pass therethrough in the width direction 51.

Spaces 86, 87 are formed on both sides of the triggering portion 85 with respect to the insertion direction 50. The space 87, the triggering portion 85, and the space 86 are arranged in this order in the insertion direction 50. The triggering portion 85 is sandwiched between spaces 86, 87 in the insertion direction 50. Light, e.g., visible or infrared light can pass through spaces 86, 87 in the width direction 51. More specifically, light emitted by the optical detector 114 can pass through spaces 86, 87 in the width direction 51.

The triggering portion 85 is aligned with an upper portion of the irradiated portion 34C in the insertion direction 50. The triggering portion 85 enters the detection area 115 of the optical detector 114 during the insertion of the ink cartridge 30 into the cartridge holder 110. Similarly, the spaces 86, 87 are aligned with the upper portion of the irradiated portion 34C in the insertion direction 50, and enter the detection area 115 of the optical detector 114 during the insertion of the ink cartridge 30 into the cartridge holder 110.

In another embodiment, translucent members may be fitted in the spaces 86, 87. The spaces 86, 87 allow light emitted by a light-emitting portion of optical detector 114 to pass therethrough, such that light with a intensity greater than or equal to a predetermined intensity reaches a light-receiving portion of optical detector 114, whereby an output signal from the optical detector 114 is determined to be a HI signal, irrespective of the presence or absence of the translucent members fitted therein.

Referring to FIGS. 2(B) and 9(A)-9(C), the structure of the type determinative portion 77 is different among the four ink cartridges 30. The structure of the type determinative portion 77 is different in whether or not the cut-outs 78, 79 are formed therethrough, corresponding to the type of the ink cartridge 30. Cut-out 78 is positioned below a boundary between the space 86 and the triggering portion 85, and cut-out 79 is positioned below a boundary between the triggering portion 85 and the space 87. The cut-out 78 is aligned with the boundary between the space 86 and the triggering portion 85 in the height direction 52. The cut-out 79 is aligned with the boundary between the triggering portion 85 and the space 87 in the height direction 52. Light, e.g., visible or infrared light can pass through cut-outs 78, 79 in the width direction 51. More specifically, light emitted by the optical detector 118 can pass through cut-outs 78, 79 in the width direction 51.

The type determinative portion 77 is aligned with the lower portion of the irradiated portion 34C in the insertion direction 50. The type determinative portion 77 enters the detection area 119 of the optical detector 118 during the insertion of the ink cartridge 30 into the cartridge holder 110.

The ink cartridge 30 shown in FIGS. 2(A) and 2(B) comprises the type determinative portion 77 having the cut-out 78 formed therethrough, but not having the cut-out 79.

The air communication opening 71 is positioned at the front wall 40 above the ink amount detection portion 34. The air communication opening 71 penetrates through the front wall 40, and the exterior of the ink cartridge 30 can be in fluid communication with the ink chamber 36 via the air communication opening 71. When the ink cartridge 30 is in an unused state (for example, when the ink cartridge 30 is shipped from a factory), the air communication opening 71 is sealed with a sticker or the like from the outside. Therefore, if the ink chamber 36 is depressurized for example, the depressurized state is maintained. When the ink cartridge 30 is used, the sticker is torn or removed, and hence the ink chamber 36 is brought into an atmospheric pressure.

The ink supply portion 72 is positioned below the ink amount detection portion 34. The ink supply portion 72 is made of a resilient cylindrical member, such as rubber, and extends from the front wall 40 forward in the insertion direction 50. The ink supply portion 72 has a through hole 73 formed through the center thereof, and the ink stored in the ink chamber 36 can flow out through the through hole 73.

The ink cartridge 30 comprises a rib 43 extending in the depth direction 53. The rib 43 comprises two side surfaces extending upward from an upper wall 39 of the ink cartridge 30 and an upper surface connecting top ends of the both side surfaces with each other. The width of the rib 43 is less than the width of the upper wall 39 in the width direction 51. An end surface 44 of the rib 43 is flush with the front wall 40, and an engaging surface 45 opposite the end surface 44 is positioned at a middle portion of the upper wall 39 in the depth direction 53. The engaging surface 45 of the rib 43 is a portion with which a lock lever 145 engages when the ink cartridge 30 is mounted to the cartridge holder 110.

The projecting member 76 is configured to contact a sliding member 135 and causing the sliding member 135 to slide during the insertion of the ink cartridge 30 into the cartridge holder 110. The projecting member 76 is positioned below the ink supply portion 72, and extends from the front wall 40 forward in the insertion direction 50. The width of the projecting member 76 is the same as the width of the front wall 40 in the width direction 51. The projecting member 76 extends from the front wall 40 further than the ink supply portion 72, i.e., the distance from the front wall 40 to the front end of the projecting member 76 is greater than the distance from the front wall 40 to the front end of the ink supply portion 72.

Figure 3A:
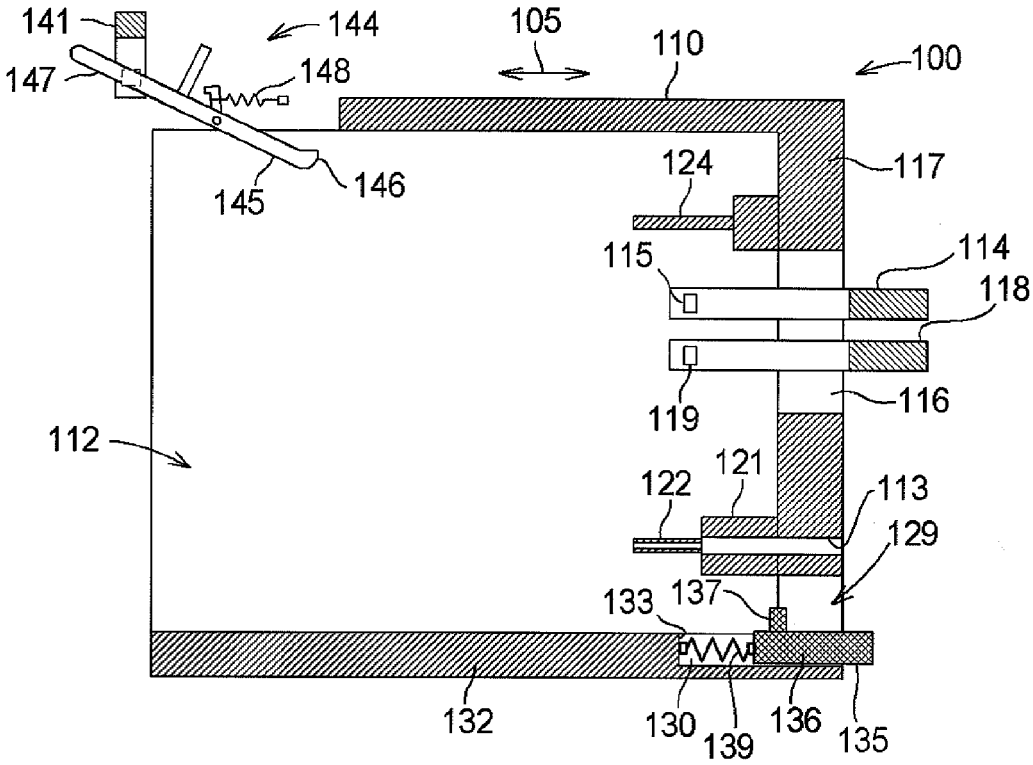
FIGS. 3(A) and 3(B) are vertical cross-sectional views of a cartridge holder according to an embodiment of the present invention, in which a lock lever is in a lock position in FIG. 3(A) and in an unlock position in FIG. 3(B).
Figure 3B:
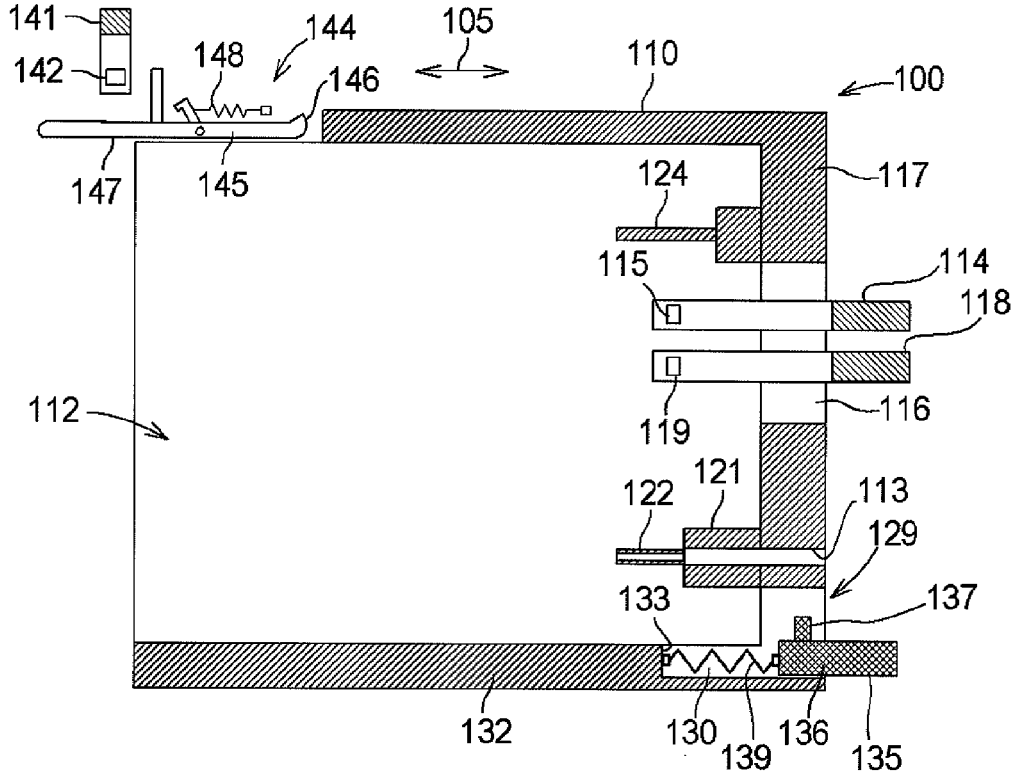

Referring to FIGS. 3(A) and 3(B), the cartridge holder 110 is configured to accommodate the ink cartridges 30 in the interior thereof. The cartridge holder 110 has an opening 112 at the front side of the printer 12 (left side in FIGS. 3(A) and 3(B)). The ink cartridges 30 are inserted into the cartridge holder 110 through the opening 112. A direction in which the ink cartridge 30 is inserted into the cartridge holder 110 is referred to as the insertion direction 50, the direction in which the ink cartridge 30 is removed from the cartridge holder 110 is referred to as the removal direction 54, and the directions along the insertion direction 50 and the removal direction 54 is referred to as insertion/removal directions 105. The cartridge holder 110 allows the four ink cartridges 30 to be mounted thereto. Although a structure of the cartridge holder 110 for one of the ink cartridges 30 to be mounted to the cartridge holder 110 is described below, the structure described below is provided for each of the ink cartridges 30 to be mounted to the cartridge holder 110. In other words, in the cartridge holder 110, the respective components described below are provided on the cartridge holder 110 corresponding to the four ink cartridges 30.

Referring to FIGS. 3(A) and 3(B), the cartridge holder 110 comprises an end wall 117 opposite the opening 112. The end wall 117 has an opening 116 formed therethrough along the insertion/removal directions 105 at a middle portion of the end wall 117 with respect to the height direction 52. The optical detector 114, as an example of a first detector, is positioned in the opening 116 of the end wall 117. The optical detector 114 projects from the end wall 117 toward the opening 112 in the removal direction 54. The optical detector 114 is configured to detect the light-blocking panel 62 positioned in the ink amount detection portion 34 and the triggering portion 85. Therefore, the optical detector 114 is provided at a position corresponding to the ink amount detection portion 34 and the triggering portion 85 with respect to the height direction 52. The triggering portion 85 enters the detection area 115 of the optical detector 114 first, and then the ink amount detection portion 34 enters the detection area 115 during the insertion of the ink cartridge 30 into the cartridge holder 110.

The optical detector 114 is a transmissive photo-interrupter comprising the light-receiving portion (not shown) configured to receive light and the light-emitting portion (not shown) configured to emits light, e.g., visible or infrared light, toward the light-receiving portion. The light-emitting portion may be a light-emitting diode, and the light-receiving portion may be a photo-transistor. The light-emitting portion and the light-receiving portion are positioned so as to face each other in the width direction 51, and an optical path between the light-emitting portion and the light-receiving portion corresponds to the detection area 115. When the light-blocking panel 62 positioned in the ink amount detection portion 34 and the triggering portion 85 enter the detection area 115, respectively, and hence the intensity of light received by the light-receiving portion is changed, a signal output from the light-receiving portion to a controller 90 (see FIG. 4) is changed. With this change of the signal, the light-blocking panel 62 and the triggering portion 85 are detected. As described later, in this embodiment, a LOW signal output from the optical detector 114 corresponds to first detection information.

Referring to FIGS. 3(A) and 3(B), the optical detector 118, as an example of a second detector, is positioned in the opening 116 of the end wall 117 below the optical detector 114. The optical detector 118 projects from the end wall 117 toward the opening 112 in the removal direction 54. The optical detector 118 is configured to detect the light-blocking panel 62 positioned in the ink amount detection portion 34 and the type determinative portion 77. Therefore, the optical detector 114 is provided at a position corresponding to the ink amount detection portion 34 and the type determinative portion 77 with respect to the height direction 52. The type determinative portion 77 enters the detection area 119 of the optical detector 118 first, and then the ink amount detection portion 34 enters the detection area 119 during the insertion of the ink cartridge 30 into the cartridge holder 110.

The optical detector 118 is a transmissive photo-interrupter comprising a light-receiving portion (not shown) configured to receive light and a light-emitting portion (not shown) configured to emit light, e.g., visible or infrared light, toward the light-receiving portion. The light-emitting portion may be a light-emitting diode, and the light-receiving portion may be a photo-transistor. The light-emitting portion and the light-receiving portion are arranged so as to face each other in the width direction 51, and an optical path between the light emitting portion and the light receiving portion corresponds to the detection area 119. When the light-blocking panel 62 positioned in the ink amount detection portion 34 and type determinative portion 77 enters the detection area 119, respectively, and hence the intensity of light received by the light-receiving portion is changed, a signal output from the light receiving portion to the controller 90 (see FIG. 4) is changed. With this change of the signal, the light-blocking panel 62 and the type determinative portion 77 are detected. As described later, in this embodiment, a LOW signal output from the optical detector 118 corresponds to second detection information.

Referring to FIGS. 3(A) and 3(B), the cartridge holder 110 is provided with the sliding member 135. The sliding member 135 is positioned in a recess 130 formed in a bottom wall 132 of the cartridge holder 110 adjacent to the end wall 117. An opening 129 is formed through the end wall 117 in the insertion/removal directions 105 at a lower portion of the end wall 117. The recess 130 continues to the opening 129. The sliding member 135 is configured to slide in recess 130 along a bottom surface of the recess 130 in the insertion/removal directions 105 of the ink cartridge 30.

The sliding member 135 is provided with an contact portion 137 with which the projecting member 76 of the ink cartridge 30 comes into contact during the insertion of the ink cartridge 30 into the cartridge holder 110. The contact portion 137 projects upward from a main body 136 of the sliding member 135. The contact portion 137 is positioned corresponding to the projecting member 76 with respect to the height direction 52.

A coil spring 139 is positioned in the recess 130. One end of the coil spring 139 is connected to an end surface 133 of the recess 130 positioned at the opening 112 side of the recess 130. The other end of the coil spring 139 is connected to the main body 136 of the sliding member 135, such that the coil spring 139 is positioned between the end surface 133 of the recess 130 and the main body 136 of the sliding member 135. During the insertion of the ink cartridge 30 into the cartridge holder 110, the projecting member 76 of the ink cartridge 30 presses the contact portion 137. Referring to FIG. 3(B), upon receipt of a pressing force from the projecting member 76, the sliding member 135 moves in the insertion direction 50, and the coil spring 139 is expanded in association therewith. When this occurs, the coil spring 139 tries to contract, and therefore the sliding member 135 receives a pulling force from the coil spring 139 in the removal direction 54 toward the opening 112.

Referring to FIGS. 3(A) and 3(B), the cartridge holder 110 is provided with a lock mechanism 144. The lock mechanism 144 locks the ink cartridge 30 in a mounted state in which the ink cartridge 30 is mounted to the cartridge holder 110, such that the ink cartridge 30 is prevented from moving in the removal direction 54. The ink cartridge 30 is retained in the mounted state by the lock mechanism 144.

The lock mechanism 144 is positioned at an upper portion of the cartridge holder 110 adjacent to the opening 112 of the cartridge holder 110. The lock mechanism 144 comprises the lock lever 145 and a coil spring 148. The lock lever 145 is supported by the cartridge holder 110 via a supporting shaft 149, and is configured to pivot between an unlock position shown in FIG. 3(B) and a lock position shown in FIG. 3(A). The coil spring 148 urges the lock lever 145 toward the lock position. An end of the lock lever 145 in the insertion direction 50 is an engaging end 146 configured to come into contact with the engaging surface 45 of the ink cartridge 30, such that the ink cartridge 30 is locked with respect to the removal direction 54 against an urging force applied from the coil spring 139 transmitted via the sliding member 135.

An end of the lock lever 145 opposite engaging end 146 is an operating portion 147. When the operating portion 147 is pressed downward, the lock lever 145 in the lock position pivots to the unlock position against an urging force applied from the coil spring 148. When this occurs, the ink cartridge 30 can be removed from the cartridge holder 110.

An optical detector 141 is provided adjacent to the lock mechanism 144. The optical detector 141 has a structure similar to the optical detectors 114, 118 described above, and comprises a detection area 142. The optical detector 141 is arranged, such that the detection area 142 is positioned in a range of rotation of the operating portion 147 of the lock lever 145. Therefore, the operating portion 147 is configured to enter the detection area 142 according to the position of the lock lever 145. The operating portion 147 is positioned in the detection area 142 when the lock lever 145 is in the lock position, and the operating portion 147 is positioned out of the detection area 142 when the lock lever 145 is in the unlock position. As such the position of the lock lever 145 is detected by the optical detector 141.

Referring to FIGS. 3(A) and 3(B), an opening 113 is formed through the lower portion of the end wall 117 from the inner surface of the end wall 117 to the outer surface of the end wall 117. A connecting portion 121 and an ink supply tube 122 are provided at the inner surface of the end wall 117 so as to be in fluid communication with the opening 113. The flexible ink tube 20 (see FIG. 1) is connected to the outer surface of the end wall 117 so as to be in fluid communication with the opening 113. When the ink cartridge 30 is mounted to the cartridge holder 110, the ink supply tube 122 is inserted into the through hole 73 of the ink supply portion 72. Accordingly, an ink path extending from the ink chamber 36 of the ink cartridge 30 via the through hole 73 of the ink supply portion 72, the ink supply tube 122 to the connecting portion 121 is formed, and the ink stored in the ink chamber 36 is supplied to the printhead 21 via the ink tube 20.

A rod 124 is provided at the upper portion of the end wall 117. The rod 124 projects from the end wall 117 toward the opening 112 in the removal direction 54. When the ink cartridge 30 is mounted to the cartridge holder 110, the rod 124 is inserted into the air communication opening 71. Accordingly, a seal member which has sealed the air communication opening 71 is torn, and the ink chamber 36 is brought into fluid communication with the atmosphere.

Figure 4:
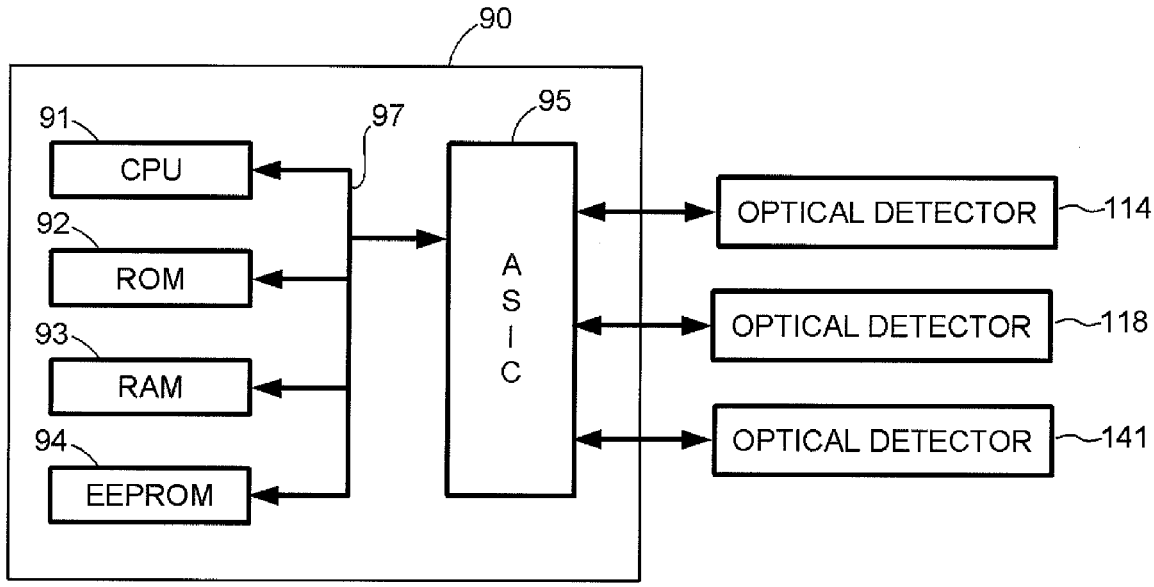
FIG. 4 is a block diagram of a configuration of a controller according to an embodiment of the present invention.

Referring to FIG. 4, the controller 90 is configured to perform a type determination for determining the type of the ink cartridge 30 based on output signals of the optical detector 118 at particular timings when the triggering portion 85 passes through the detection area 115 of the optical detector 114 during the insertion of the ink cartridge 30 into the cartridge holder 110, and perform an ink amount determination based on output signals from the optical detectors 114, 118. Moreover the controller 90, as an example of a first determiner and a second determiner, is also configured to determine whether the mounting of the ink cartridge 30 to the cartridge holder 110 has been completed, and whether the ink cartridge 30 is being inserted into the cartridge holder 110, based on the output signal from the optical detector 141.

In this embodiment, the controller 90 is configured to control the entire operation of the printer 12. Nevertheless, because configurations relating to control of the printhead 21 and the paper feed roller 23 etc. do not relate directly to the present invention, detailed description thereof is omitted.

Referring to FIG. 4, the controller 90 is configured as a microcomputer comprising a CPU 91, a ROM 92, a RAM 93, an EEPROM 94, and an ASIC 95.

The ROM 92 stores programs for the CPU 91 to control various operations of the printer 12, programs for the CPU 91 to perform the type determination, the ink amount determination, an insertion determination, and a mounted state determination describe later, and a table indicating one-to-one correspondence between the types of the ink cartridges 30 and output signals from the optical detector 118. The RAM 93 is used as a storage area for temporality storing data or signals or a work area for the data processing for the CPU 91 to execute the programs described above. The EEPROM 94 stores settings, flags, and the like which are to be retained even after the power source is turned OFF.

The CPU 91, the ROM 92, the RAM 93, and the EEPROM 94 are electrically connected to the ASIC 95 via a bus 97 so as to be capable of communicating with each other. The optical detectors 114, 118, 141 are electrically connected to the ASIC 95, such that the optical detectors 114, 118 141 can output signals to the ASIC 95.

Each of the optical detectors 114, 118, 141 outputs an analogue electric signal (voltage signal or current signal) according to the intensity of light received by the light-receiving portion of the optical detectors 114, 118, 141. When the electric level (voltage value or current value) of the signal output from the optical detector 114, 118, or 141 is greater than or equal to a predetermined threshold value, the controller 90 determines that the signal is a HI signal, and when the electric level is less than the predetermined threshold value, the controller 90 determines that the signal is a LOW signal. In this embodiment, the signal output from the optical detector 114, 118, or 141 is determined to be the LOW signal when the light emitted from the light-emitting portion of the optical detector 114, 118, or 141 is blocked in the detection area 115, 119, or 142, and to be the HI signal when the light is not blocked. The LOW signal output by the optical detector 114 corresponds to first detection information, and the LOW signal output by the optical detector 118 corresponds to second detection information.

Referring to FIG. 5(A), when the ink cartridge 30 is inserted into the cartridge holder 110 in the insertion direction 50, the rib 43 comes into contact with the engaging end 146 of the lock lever 145. Accordingly, the lock lever 145 pivots counterclockwise and the engaging end 146 is moved upward, such that the position of the lock lever 145 is changed from the lock position to the unlock position. When the lock lever 145 is in the unlock position, the operating portion 147 of the lock lever 145 is positioned out of the detection area 142 of the optical detector 141, and the output signal from the optical detector 141 is changed from the LOW signal to the HI signal. Based on this change of the output signal from the optical detector 141, the controller 90 determines that the ink cartridge 30 is started to be inserted into the cartridge holder 110 (See FIG. 8: S1 YES). As long as the output signal from the optical detector 141 is the HI signal, the controller 90 determines that the ink cartridge 30 is being inserted into the cartridge holder 110

When the ink cartridge 30 is further inserted in the insertion direction 50, the space 86 enters the detection area 115 of the optical detector 114, and then the triggering portion 85 enters the detection area 115 of the optical detector 114. Accordingly, the output signal from the optical detector 114 is changed from the HI signal to the LOW signal (See FIG. 7: T1). The controller 90 determines that the triggering portion 85 is detected (See FIG. 8: S2 YES).

Figure 8:
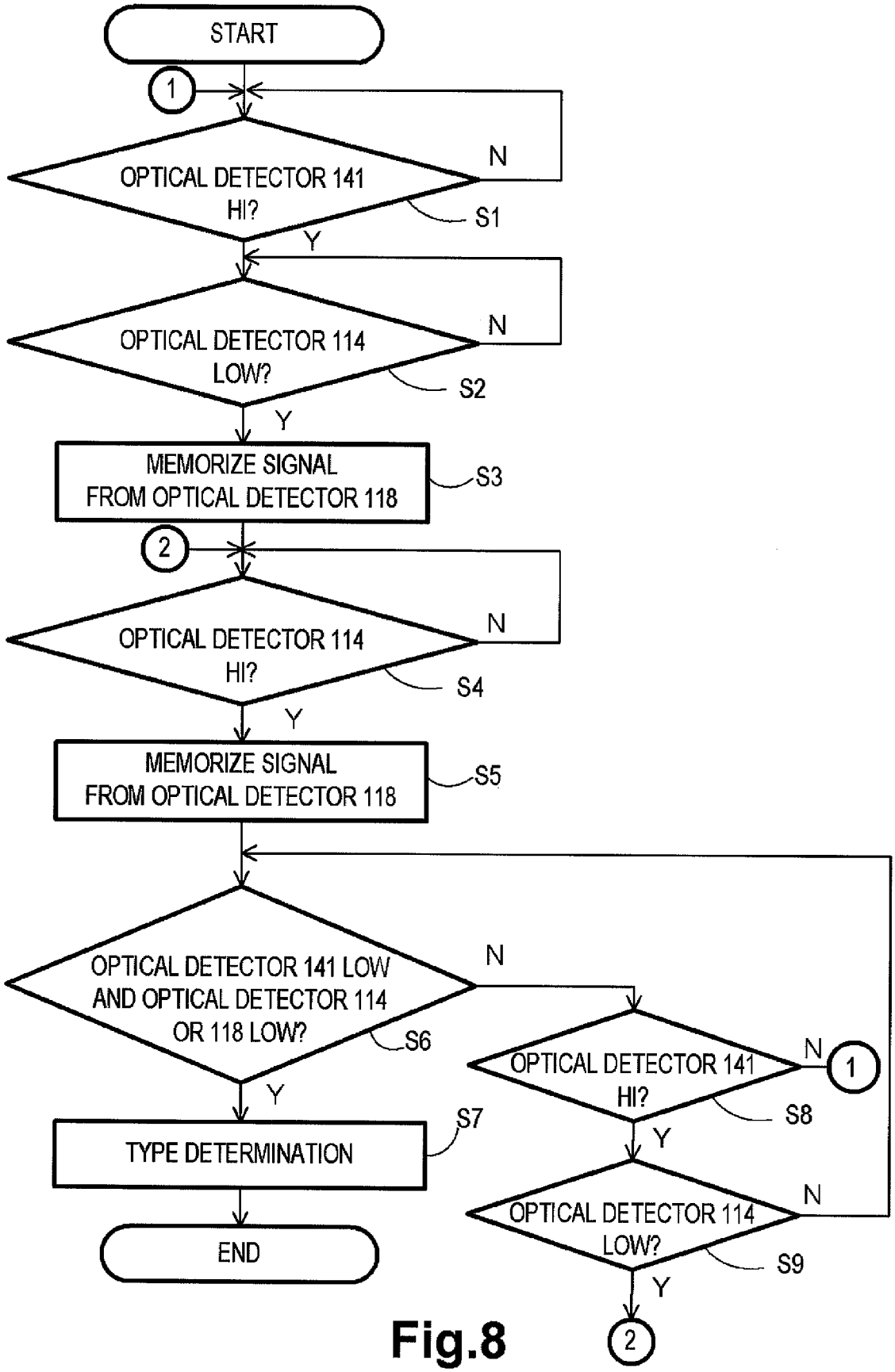
FIG. 8 is a flowchart of a type determination performed by a controller.
Figure 9A:
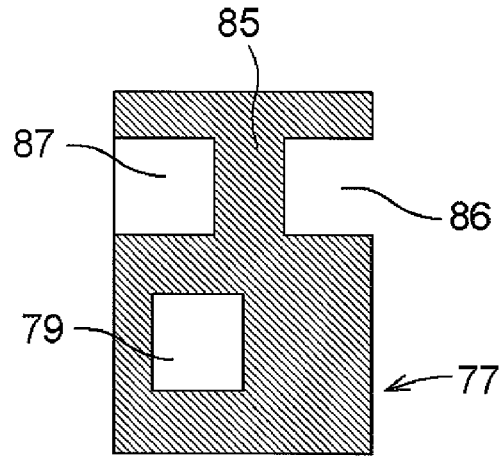
FIGS. 9(A)-9(C) are enlarged cross-sectional views of type determinative portions of different types of the ink cartridges.
Figure 9B:
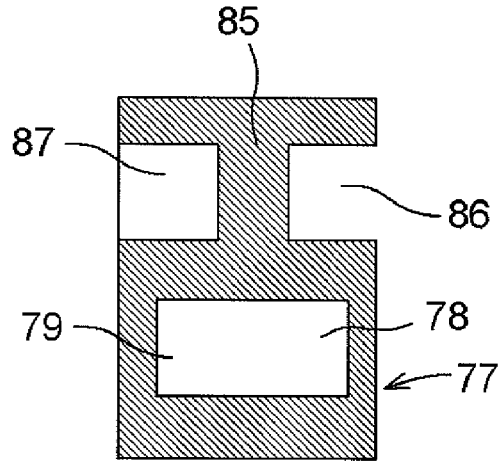
Figure 9C:
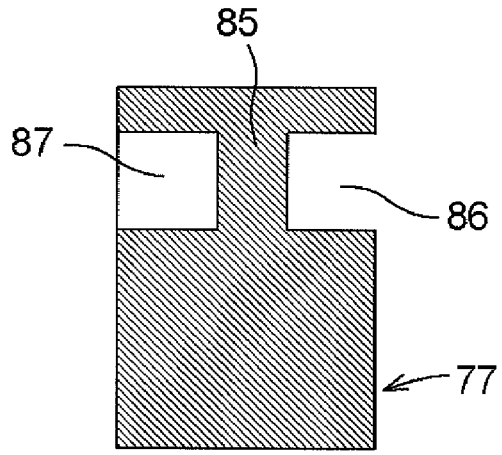
Figure 10A:
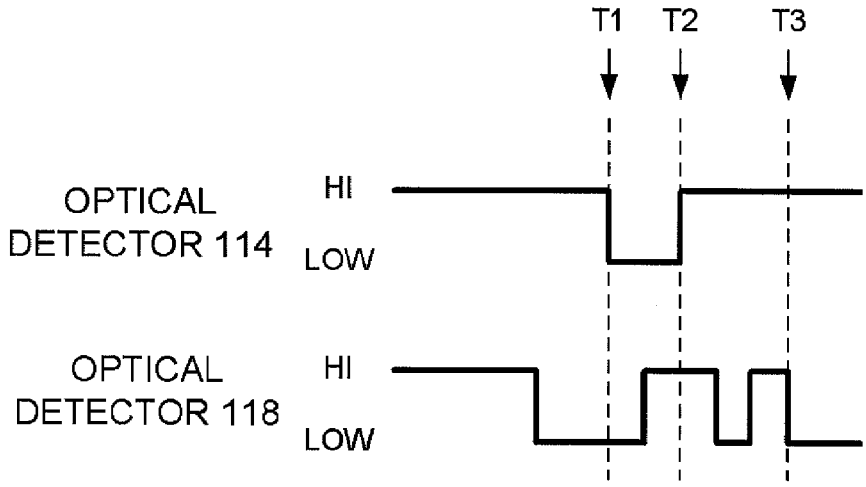
FIGS. 10(A)-10(C) are time profiles of output signals from two optical detectors, caused by the type determinative portions of FIGS. 9(A)-9(C), respectively.
Figure 10B:
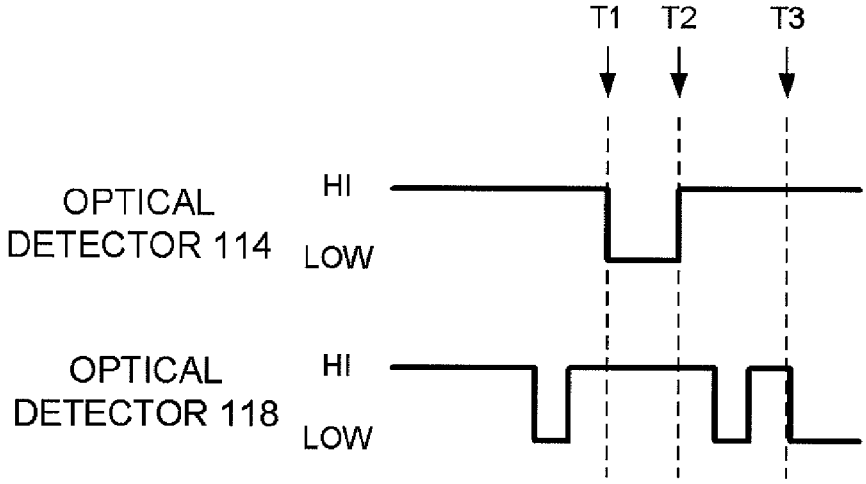
Figure 10C:
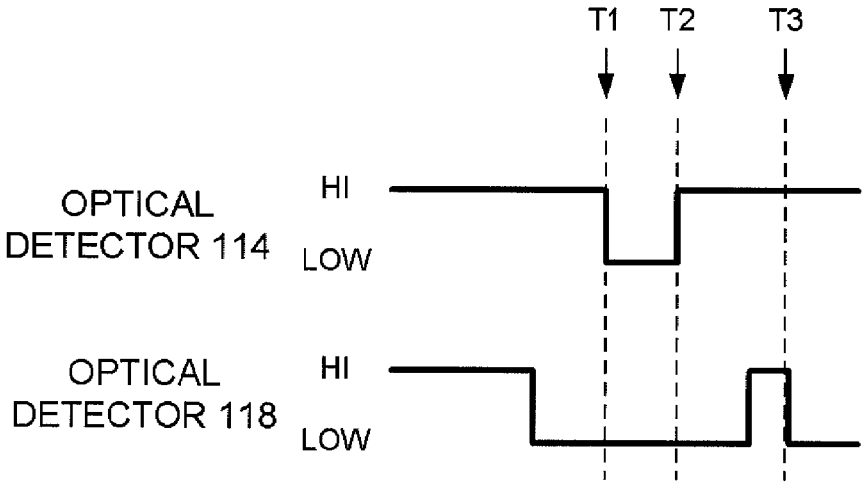

The controller 90 determines and memorizes the signal output from the optical detector 118 at the timing T1 (See FIG. 7) when the output signal from the optical detector 114 changes from the HI signal to the LOW signal, i.e., when the optical detector 114 begins outputting the LOW signal (See FIG. 8: S3). Here, because the ink cartridge 30 having the cut-out 78 formed through the type determinative portion 77 is inserted into the cartridge holder 110, the output signal from the optical detector 118 is the HI signal at the timing T1 when the output signal from the optical detector 114 changes from the HI signal to the LOW signal (See FIG. 7). The controller 90 stores the output signal from the optical detector 118 at the timing T1 into the RAM 93, as first determination information.

Figure 5B:
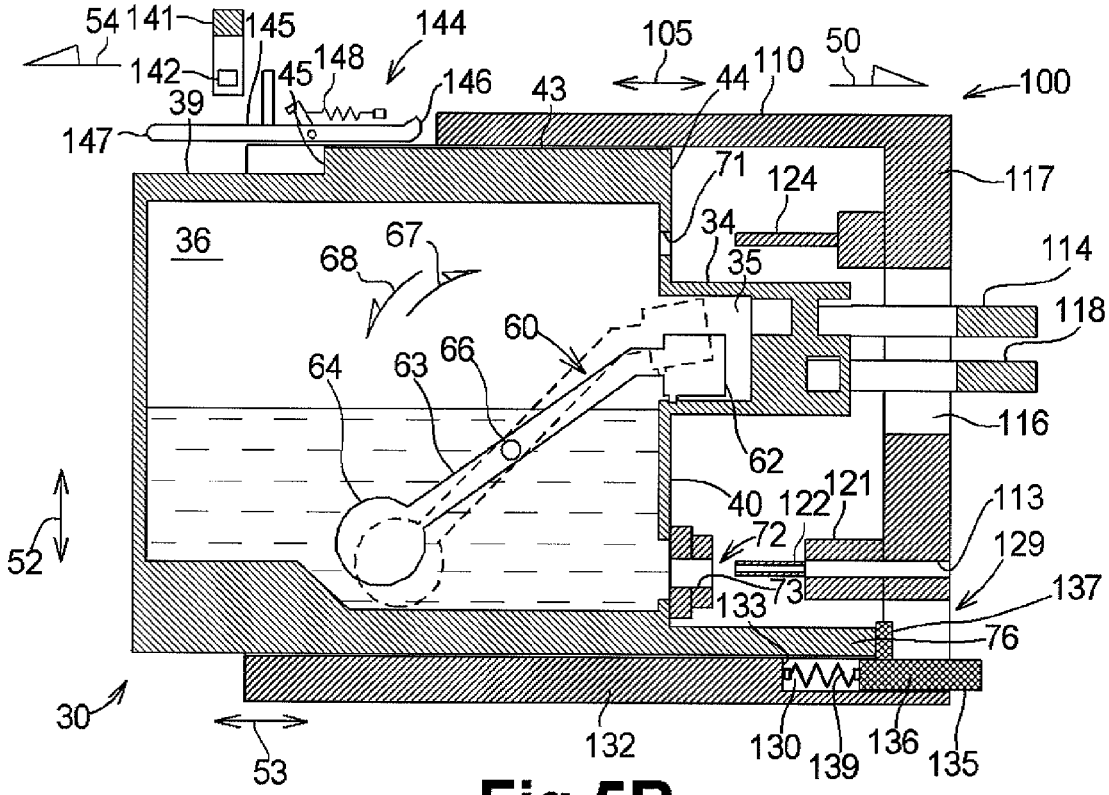
FIG. 5(B) is a vertical cross-sectional view of the ink cartridge and the cartridge holder, in which the ink cartridge is further inserted into the cartridge holder from the state shown in FIG. 5(A).

Referring to FIG. 5(B), when the ink cartridge 30 is further inserted in the insertion direction 50, the triggering portion 85 passes the detection area 115 of the optical detector 114, and then the space 87 enters the detection area 115. Accordingly, the output signal from the optical detector 114 is changed from the LOW signal to the HI signal (FIG. 7: T2). The controller 90 determines that the optical detector 114 stops detecting the triggering portion 85 (FIG. 8: S4 YES).

The controller 90 determines and memorizes the signal output from the optical detector 118 at the timing T2 (See FIG. 7) when the output signal from the optical detector 144 changes from the LOW signal to the HI signal, i.e., when the optical detector 114 stops outputting the LOW signal (FIG. 8: S5). Here, because the ink cartridge 30 which does not have the cut-out 79 formed through the type determinative portion 77 is inserted into the cartridge holder 110, the level of the output signal from the optical detector 118 is the LOW signal at the timing T2 when the output signal from the optical detector 144 changes from the LOW signal to the HI signal (See FIG. 7). The controller 90 stores the output signal from the optical detector 118 at the timing T2 into the RAM 93 as second determination information. In other words, the RAM 93 stores a combination (HI, LOW) of the output signals.

Figure 6:
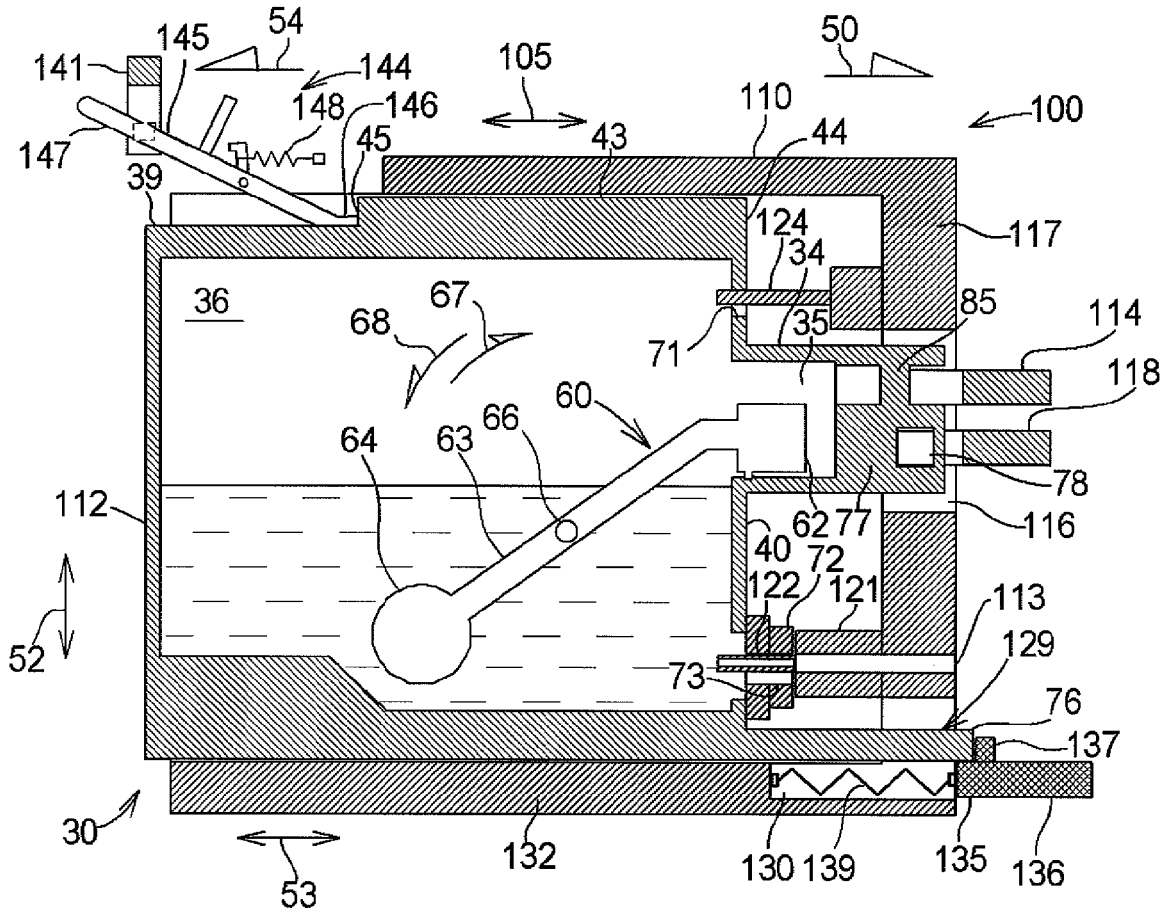
FIG. 6 is a vertical cross-sectional view of the ink cartridge of FIGS. 2(A) and 2(B) and the cartridge holder of FIGS. 3(A) and 3(B), in which the ink cartridge is in a mounted state.
Figure 7:
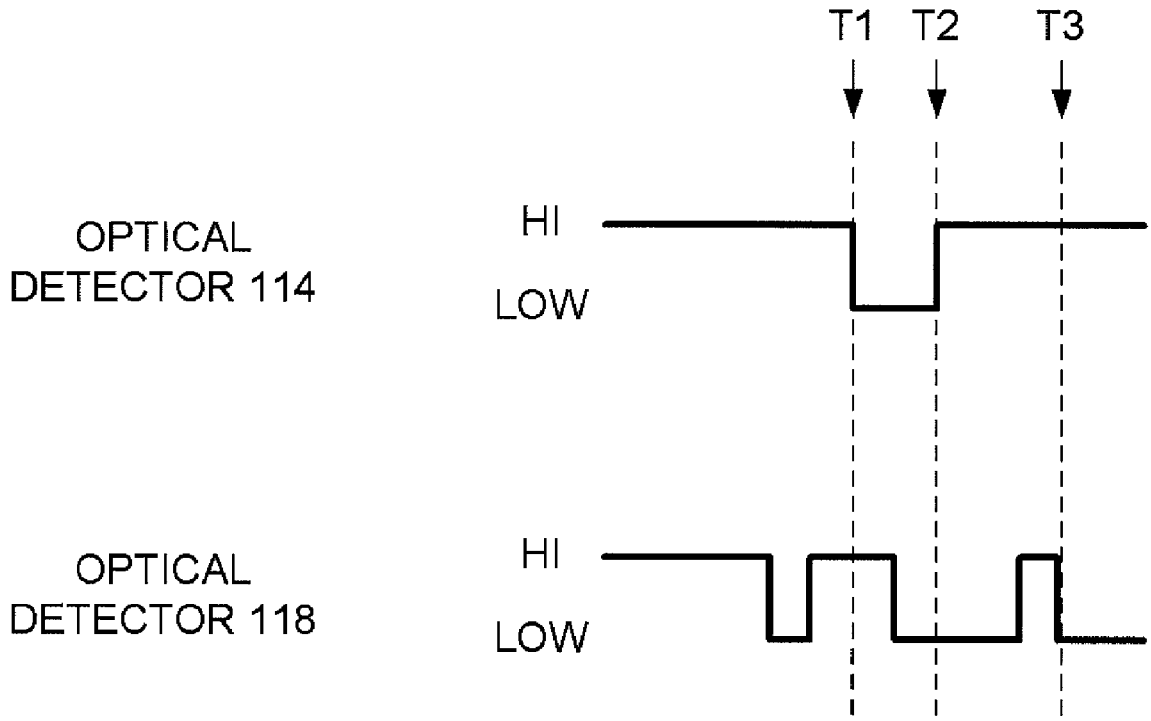
FIG. 7 is time profiles of output signals from two optical detectors.

Referring to FIG. 6, when the insertion of the ink cartridge 30 into the cartridge holder 110 is completed and the ink cartridge 30 is in the mounted state being locked by the lock lever 145, the irradiated portion 34C of the ink amount detection portion 34 enters the detection areas 115, 119 of the respective optical detectors 114, 118. Because the predetermined amount or more of ink is stored in the ink chamber 36 in the new ink cartridge 30, the light of the optical detector 118 is blocked in the detection area 119 by the light-blocking panel 62 of the detection arm 60 positioned in the lower position. Therefore, the output signal from the optical detector 118 is changed from the HI signal to the LOW signal (See FIG. 7: T3). On the other hand, because the light of the optical detector 114 in the detection area 115 is not blocked by the light-blocking panel 62 positioned in the lower position, the output signal from the optical detector 114 is the HI signal (See FIG. 7: T3).

By the time the ink cartridge 30 becomes the mounted state, the engaging surface 45 of the rib 43 has passed the engaging end 146 of the lock lever 145 in the insertion direction 50. Because the engaging end 146 of the lock lever 145 is not supported by the rib 43 any longer, the lock lever 145 in the unlock position pivots to the lock position by being urged by the coil spring 148, and the engaging end 146 of the lock lever 145 comes into contact with the engaging surface 45 of the rib 43. Accordingly the ink cartridge 30 is locked against the urging force applied from the coil spring 139 via the sliding member 135 and is retained in the mounted state. When the lock lever 145 moves the lock position, the operating portion 147 of the lock lever 145 enters the detection area 142 of the optical detector 141, and the output signal from the optical detector 141 is changed from the HI signal to the LOW signal.

The controller 90 determines that the ink cartridge 30 has reached the mounted state, i.e., that the mounting of the ink cartridge 30 to the cartridge holder 110 has been completed, based on the fact that at least one of the output signals of the optical detectors 114, 118 is the LOW signal and the output signal from the optical detector 141 is the LOW signal (FIG. 8: S6 YES).

When it is determined that the ink cartridge 30 is in the mounted position, i.e., that the mounting of the ink cartridge 30 to the cartridge holder 110 has been completed, the controller 90 performs the type determination based on the first determination information and the second determination information, i.e., determines the type of the mounted ink cartridge 30 based on the combination (HI, LOW) of the output signals from the optical detector 118 stored in the RAM 93 (See FIG. 8: S7). In this type determination, the ink color stored in the mounted ink cartridge 30 is determined with reference to the table stored in the ROM 92. Here, it is determined that the ink cartridge 30 storing an ink color corresponding to the combination (HI, LOW) has been mounted.

Referring to FIGS. 2(B) and 9(A)-9(C), depending on the presence or absence of the two cut-outs 78, 79 in the type determinative portion 77, there exist four combinations of the output signals from the optical detector 118; (HI, HI), (HI, LOW), (LOW, HI), and (LOW, LOW) as shown in FIGS. 7 and 10(A)-10(C). These four combinations are allocated to the respective ink colors of Cyan, Magenta, Yellow, and Black, and the type of ink cartridges 30 is determined among these four types. The two cut-outs 78, 79 are formed as one space in FIG. 9(B). In another embodiment, these two cut-outs 78, 79 may be formed as independent spaces aligned in the insertion direction 50.

When the ink cartridge 30 is mounted to the cartridge holder 110, the ink supply tube 122 is inserted into the through hole 73 of the ink supply portion 72, and the ink stored in the ink chamber 36 is supplied to the printhead 21 through the ink tube 20. Also, the rod 124 is inserted into the air communication opening 71, and the ink chamber 36 is in fluid communication with the atmosphere.

Figure 11:
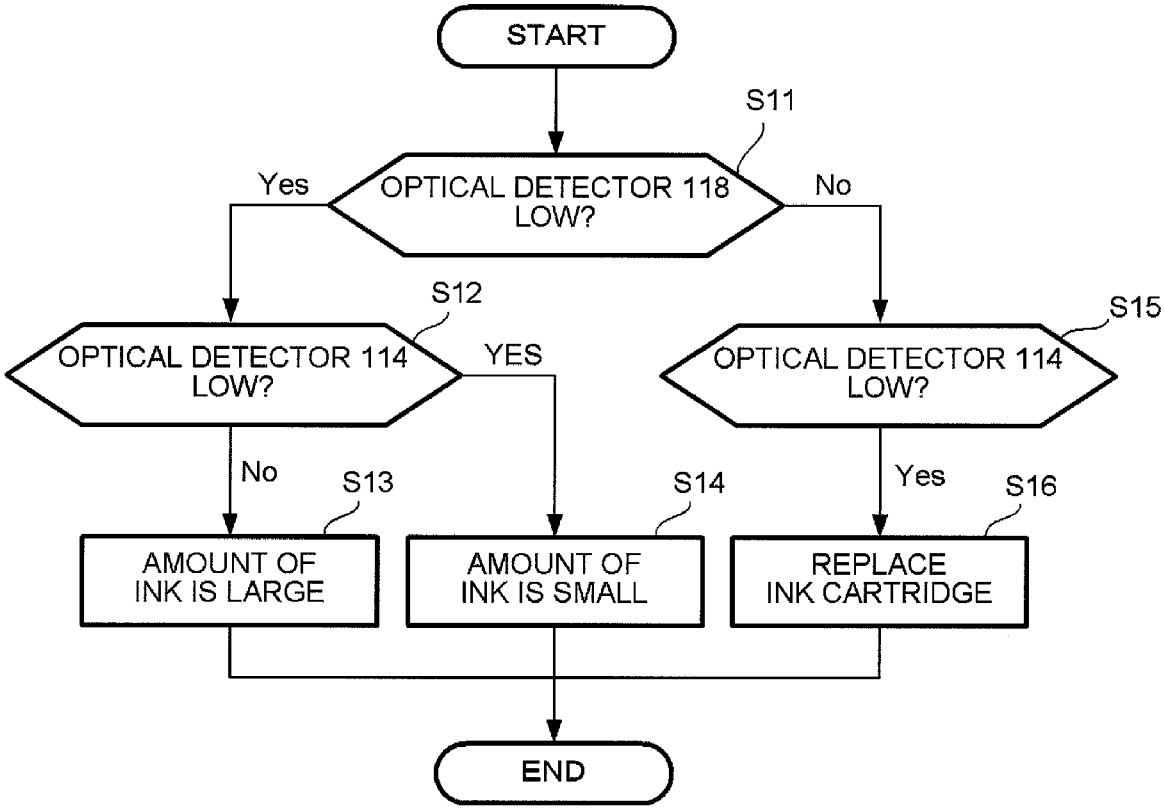
FIG. 11 is a flowchart of an ink amount determination performed by the controller.

Referring to FIG. 11, the controller 90 is configured to monitor and determine the amount of ink stored in the ink chamber 36 after it is determined that the ink cartridge 30 has reaches the mounted state. More specifically, when the predetermined amount or more of ink is stored in the ink chamber 36, the light-blocking panel 62 positioned in the lower position blocks the light of optical detector 118, but does not block the light of optical detector 114. Therefore, the output signal from the optical detector 118 is the LOW signal (S11: Yes) and the output signal from the optical detector 114 is the HI signal (S12: No). In this state, the controller 90 determines that a large amount of ink is stored in the ink chamber 36 (S13).

When the ink stored in the ink chamber 36 is consumed and the amount of ink becomes less than the predetermined amount, the light-blocking panel 62 starts to change its position from the lower position toward the upper position. When the light-blocking panel 62 is positioned between the lower position and the upper position, the light-blocking panel 62 blocks both of the lights from the optical detectors 114, 118, and the output signals from the optical detectors 114, 118 are both the LOW signals (S11: Yes and S12: Yes). In this state, the controller 90 determines that a small amount of ink is stored in the ink chamber 36 (S14).

Further, when the amount of ink stored in the ink chamber 36 is further reduced, the light-blocking panel 62 of the detection arm 60 changes its position to the upper position. The light-blocking panel 62 positioned in the upper position blocks the light of optical detector 114, but does not block the light of optical detector 118. Therefore, the output signal from the optical detector 118 is the HI signal (S11: No) and the output signal from the optical detector 114 is the LOW signal (S15: Yes). In this state, the controller 90 determines that the ink cartridge 30 mounted in the cartridge holder 110 is needed to be replaced (S16). These kinds of information relating to the amount of ink is displayed on a display of the printer 12 for example, or displayed on a display of an external information apparatus to which the printer 12 is connected, or notified by a buzzer or light.

In some occasion, the ink cartridge 30 may move back and force in the insertion direction 50 and the removal direction 54 during the insertion of the ink cartridge 30 into the cartridge holder 110.

If the ink cartridge 30 moves in the removal direction 54 after the output signal from the optical detector 118 is stored in the RAM 93 (FIG. 8: S3) at the timing when the output signal from the optical detector 114 changes from the HI signal to the LOW signal as shown in FIG. 5(A), the triggering portion 85 moves out of the detection area 115 of the optical detector 114 and the output signal from the optical detector 114 changes from the LOW signal to the HI signal. Therefore, the change of the output signal from the optical detector 114 is from the LOW signal to the HI signal either when the ink cartridge 30 moves in the insertion direction 50 from the state shown in FIG. 5(A) or when the ink cartridge 30 moves in the removal direction 54 from the state shown in FIG. 5(A).

As described above, if the ink cartridge 30 moves in the insertion direction 50 from the state shown in FIG. 5(A), the type determination portion 77 is detected at the timing when the output signal from the optical detector 114 changes from the LOW signal to the HI signal, and the LOW signal of the optical detector 118 is stored in the RAM 93. However, if the ink cartridge 30 moves in the removal direction 54 from the state shown in FIG. 5(A), the cut-out 78 of the type determination portion 77 enters the detection area 119 of the optical detector 118 at the timing when the output signal from the optical detector 114 changes from the LOW signal to the HI signal, and the HI signal of the optical detector 118 is stored in the RAM 93 (FIG. 8: S5). In other words, a combination of the output signals from the optical detector 118 stored in the RAM 93 becomes (HI, HI).

Then, when the ink cartridge 30 moves in the insertion direction 50 again without being pulled out completely from the cartridge holder 110 (FIG. 8: S8 YES), the triggering portion 85 of the ink cartridge 30 enters the detection area 115 of the optical detector 114 again as shown in FIG. 5(A) (FIG. 8: S9 YES). When this occurs, the output signal of the optical detector 118 stored in the RAM 93 at the timing when the output signal from the optical detector 114 initially changes from the HI signal to the LOW signal after the output signal of the optical detector 141 becomes the HI signal is not cleared and remains stored in the RAM 93. In other words, the first determination information is not cleared and remains stored in the RAM 93. Therefore, even if the output signal from the optical detector 114 changes from the HI signal to the LOW signal more than once after the output signal of the optical detector 141 becomes the HI signal, the first determination information initially stored in the RAM 93 remains.

Then, as shown in FIG. 5(B), when the ink cartridge 30 moves further in the insertion direction 50, the triggering portion 85 passes through the detection area 115 of the optical detector 114, and then the space 87 enters the detection area 115. Accordingly, the output signal from the optical detector 114 changes from the LOW signal to the HI signal (FIG. 8: S4 YES). When this occurs, the output signal from the optical detector 118 detecting the type determination portion 77 that does not have the cut-out 79 is the LOW signal. The controller 90 clears and newly stores the output signal from the optical detector 118 into the RAM 93 (FIG. 8: S5). In other words, the combination of output signals of (HI, HI) stored in the RAM 93 is renewed to (HI, LOW). In other words, the second determination information is cleared and renewed. Therefore, if the output signal from the optical detector 114 changes from the LOW signal to the Hi signal after the output signal of the optical detector 141 becomes the HI signal more than once, the second determination information is cleared and renewed, and the second determination information finally stored in the RAM 93 remains.

Then, as shown in FIG. 6, when the ink cartridge 30 reaches the mounted state, the type determination of the ink cartridge 30 is performed based on the output signals from the optical detector 118 stored in the RAM 93 as described above. In this manner, even though the ink cartridge 30 moves back and force, the type determination of the ink cartridge 30 is performed accurately.

If the ink cartridge 30 is pulled out completely from the cartridge holder 110 without being mounted completely after the triggering portion 85 of the ink cartridge 30 enters or passes through the detection area 115 of the optical detector 114 as shown in FIG. 5(A) or FIG. 5(B), the rib 43 of the ink cartridge 30 and the engaging end 146 of the lock lever 145 are separated away from each other and hence the lock lever 145 changes the position from the unlock position to the lock position. Accordingly, the operating portion 147 of the lock lever 145 enters the detection area 142 of the optical detector 141, and the output signal from the optical detector 141 changes from the HI signal to the LOW signal.

The controller 90 determines that the ink cartridge 30 is not in the cartridge holder 110 based on the fact that both the output signals of the optical detectors 114, 118 are the HI signals and the output signal from the optical detector 141 is the LOW signal (FIG. 8: S8 NO).

Then, when the ink cartridge 30 having been completely pulled out from the cartridge holder 110 is inserted into the cartridge holder 110 again, the triggering portion 85 of the ink cartridge 30 passes again through the detection area 115 of the optical detector 114 as shown in FIG. 5(A) and FIG. 5(B) (FIG. 8: S2 YES, S4 YES). Then, the output signals from the optical detector 118 at the respective timings described above are cleared and stored in the RAM 93 again (FIG. 8: S3, S5).

Then, as shown in FIG. 6, when the ink cartridge 30 reaches the mounted state, the type determination of the ink cartridge 30 is performed based on the output signals from the optical detector 118 stored in the RAM 93 as described above. In this manner, even though the ink cartridge 30 inserted into the cartridge holder 110 is pulled out and is inserted again, the type determination of the ink cartridge 30 is performed accurately.

As described above, the controller 90 performs the type determination of the ink cartridge 30 among the four types based on the first determination information and the second determination information, i.e., based on the signals outputted from the optical detectors 114, 118 during the insertion of the ink cartridge 30 into the cartridge holder 110. Therefore, the type determination the ink cartridges 30 among the four types is efficiently realized by the two optical detectors 114, 118.

The type of the ink cartridge 30 is determined based on the output signal of the optical detector 118 when the output signal of the optical detector 114 initially changes from the HI signal to the LOW signal after the output signal of the optical detector 141 becomes the HI signal, and based on the output signal of the optical detector 118 when the output signal of the optical detector 114 finally changes from the LOW signal to the HI signal before the mounted state is detected. Thus, irrespective of whether the ink cartridge 30 is moved back and forth in the cartridge holder 110, the type of the ink cartridge 30 is accurately determined.

The controller 90 determines the type of the ink cartridge 30 when it is determined that the mounting of the ink cartridge 30 to the cartridge holder 110 has been completed. Thus, as described above, even if the ink cartridge 30 is moved back and forth or inserted into the cartridge holder 110 and then removed from the cartridge holder 110 completely, and thereby the trigger detection portion 85 is detected a plurality of times, the type of the ink cartridge 30 is determined only when the mounting of the ink cartridge 30 to the cartridge holder 110 has been completed.

The controller 90 determines the type of the ink cartridge 30 based on the output signal of the optical detector 118 when the output signal of the optical detector 114 initially changes from the HI signal to the LOW signal and the output signal of the optical detector 118 when the output signal of the optical detector 114 finally changes from the LOW signal to the HI signal after it is detected that the ink cartridge 30 is stated to be inserted into the cartridge holder 110. Therefore, even if the ink cartridge 30 is inserted into the cartridge holder 110 and then removed from the cartridge holder 110 completely, the type of the ink cartridge 30 is accurately determined.

In this embodiment, the type of the ink cartridge 30 relates to the color of ink stored in the ink cartridge 30. In another embodiment, the type of the ink cartridge 30 may relate to the initial amount of ink stored in the ink cartridge 30. In such an embodiment, the amount of ink may be determined more accurately.

In another embodiment, the type of the ink cartridge 30 may relate to the composition of ink. Ink may include a pigment or a dye, or the composition of ink may be tailored for cold climate areas or for tropical regions. When the composition of the ink changes, the viscosity or the surface tension of the ink changes accordingly. Therefore, if the composition of the ink is changed, it may be necessary to change the control of the ink discharge in the printhead 21 correspondingly. In the embodiment in which the composition of the ink is determined, the image recording is performed with an optimal discharge control in the printhead 21.

In another embodiment, the type of the ink cartridges 30 may relate to the place of manufacture of the ink. When the place of manufacture is determined, such information is stored in the controller 90. If a quality problem occurs in the printer 12, and the printer 12 is returned to the manufacturer, the manufacturer can know the place of manufacture of the ink used in the returned printer 12 based on the information stored in the controller 90. Accordingly, studies of the quality problem may become easier.

In another embodiment, the type of the ink cartridges 30 may relate to the date of manufacture of the ink. When the date of manufacture is determined, such information is stored in the controller 90. If a quality problem occurs in the printer 12, and the printer 12 is returned to the manufacturer, the manufacturer can know the date of manufacture of the ink used in the returned printer 12 based on the information stored in the controller 90. Accordingly, studies of the quality problem may become easier.

In another embodiment, the types of the ink cartridges 30 may relate to ink cartridge 30 for general user's use and ink cartridge 30 for maintenance operator's use. The maintenance operator is a person who is able to repair the printer 12 at the site of use. The maintenance operator may perform a special operation for repairing the printer 12. For example, when the ink cartridge 30 for the maintenance operator's use is mounted to the printer 12, special operations which cannot be performed by the general users such as a purge operation discharging a large amount of ink are authorized by the controller 90.

In another embodiment, the type of the ink cartridge may relate to air solubility of ink. If the ink has a low air-solubility, the ink chamber 36 may not be depressurized. In contrast, if the ink has a high air-solubility, the ink chamber 36 may be depressurized. A program for maintaining the printhead 21 is changed based on the determination of the type relating to air solubility of ink.

In this embodiment, the light-blocking panel 62 of the detection arm 60, the type determinative portion 77, and the triggering portion 85 are configured to prevent the lights emitted from the light-emitting portions of the optical detectors 114, 118, from passing therethrough. In another embodiment, the light-blocking panel 62 of the detection arm 60, the type determinative portion 77, and the triggering portion 85 may be configured to alter the direction of light, e.g., reflect or diffract the entirety or a portion of light, such that the intensity of light received by the light-receiving portion is reduced. The light-blocking panel 62 of the detection arm 60, the type determinative portion 77, and the triggering portion 85 may be a smoke glass or an aperture configured to attenuate light, such that the intensity of light received by the light-receiving portion is reduced.

In another embodiment, if the respective timings come several times during the insertion of the ink cartridge 30 into the cartridge holder 110, all the output signals from the optical detector 118 at the respective timings (all the first determination information and the second determination information) are stored in the RAM 93 in sequence, and the controller 90 determines the type of the ink cartridge 30 by selecting the output signal of the optical detector 118 when the output signal of the optical detector 114 initially changes from the HI signal to the LOW signal after the output signal of the optical detector 141 becomes the HI signal (the first determination information initially stored in the RAM 93) and the output signal of the optical detector 118 when the output signal of the optical detector 114 finally changes from the LOW signal to the HI signal before the mounted state is detected (the second determination information finally stored in the RAM 93).

Figure 12A:
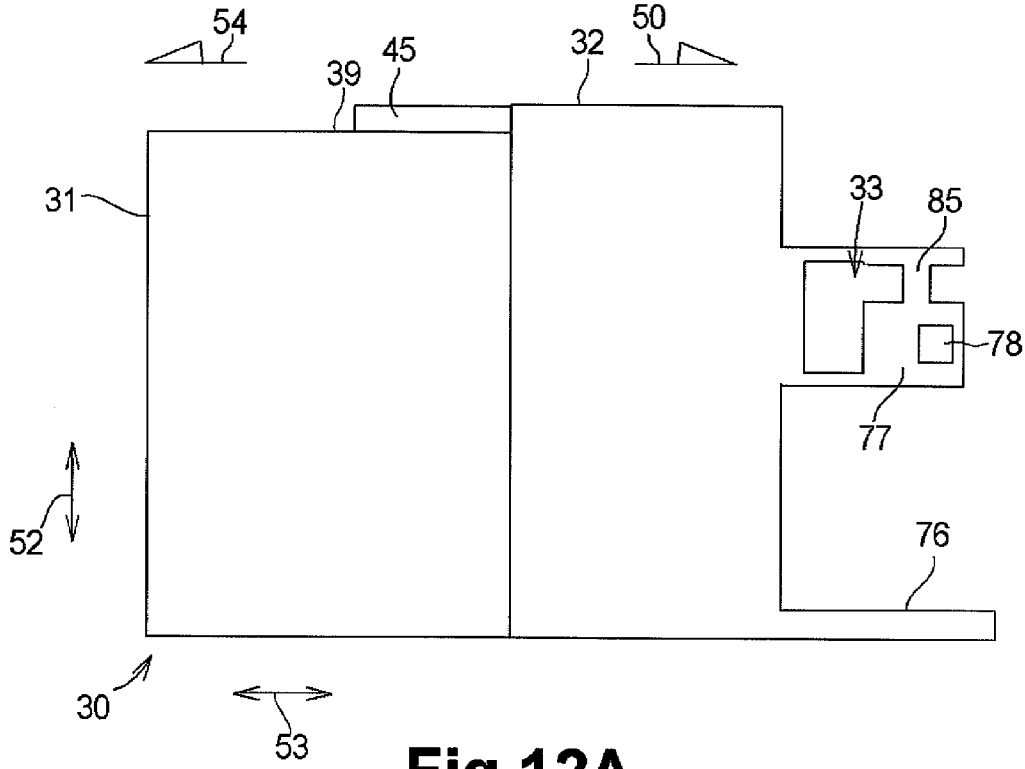
FIG. 12(A) is a side view of an ink cartridge according to a modified embodiment.
Figure 12B:
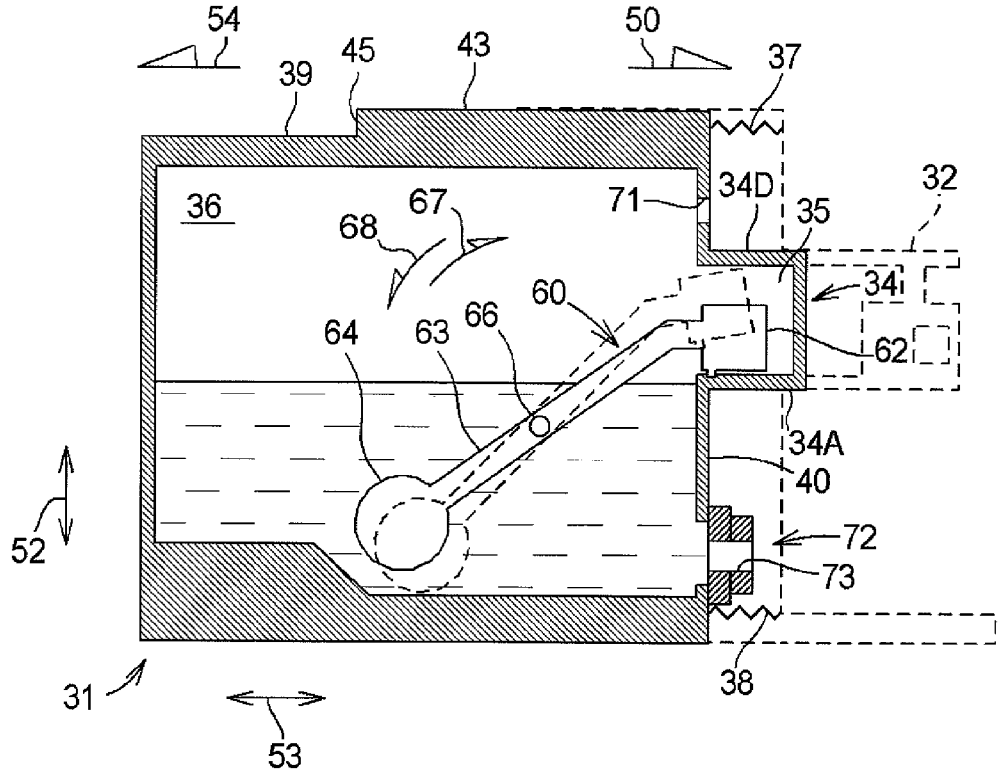
FIG. 12(B) is a vertical cross-sectional view of the ink cartridge.

Referring to FIGS. 12(A) and 12(B), in a modified embodiment, the ink cartridge 30 comprises a case 31 comprising the ink chamber 36, and a cover 32 configured to cover a front portion of case 31 with respect to the insertion direction 50.

The case 31 has the same structure as the ink cartridge 30 described in the above embodiment except that the case 31 does not comprise the projecting member 76, the type determinative portion 77, and the triggering portion 85. Therefore, the case 31 has a substantially rectangular parallelepiped shape being thin in the width direction 51, and comprises the ink chamber 36 therein. Also, the case 31 comprises the ink amount detection portion 34, the air communication opening 71, and the ink supply portion 72, which communicate with the ink chamber 36, positioned at the front thereof with respect to the insertion direction 50.

The cover 32 has a hollow box-shape covering the front portion of the case 31 with respect to the insertion direction 50. The cover 32 is configured to slide on the outer surface of the front portion of the case 31 in the insertion direction 50 so as to move relative to the case 31. The cover 32 is hooked to the case 31 at a position apart from the case 31 in the insertion direction 50 by a predetermined distance, such that a range of sliding movement is limited. Coil springs 37, 38 are interposed between the case 31 and the cover 32, and the cover 32 is urged in a direction away from the case 31 by the coil springs 37, 38.

The cover 32 comprises the projecting member 76, the type determinative portion 77, and the triggering portion 85 at the front thereof with respect to the insertion direction 50. The cover 31 comprises a window 33 formed therethrough in the width direction 51, and the window 33 is positioned at the rear of the type determinative portion 77 and the triggering portion 85 in the insertion direction 50. When the cover 32 moves and is positioned closest to the case 31, the ink amount detection portion 34 enters a position corresponding to the window 33, and the ink amount detection portion 34 is exposed to the outside of the cover 32 through the window 33. When the cover 32 moves away from the case 31, the ink amount detection portion 34 moves out from the position corresponding to the window 33, and the ink amount detection portion 34 is covered by the cover 32. The window 33 allows light of the optical detector 114 to path therethrough.

The cover 32 comprises a through hole which allows insertion of the rod 124 therethrough, and a through hole which allows insertion of the connecting portion 121 and the ink supply tube 122 therethrough, formed through the front wall of the cover 32 with respect to the insertion direction 50 at positions corresponding to the air communication opening 71 and the ink supply portion 72, respectively. The rod 124 is guided to the air communication opening 71, and the connecting portion 121 and the ink supply tube 122 are guided to the ink supply portion 72 via these through holes.

Figure 13:
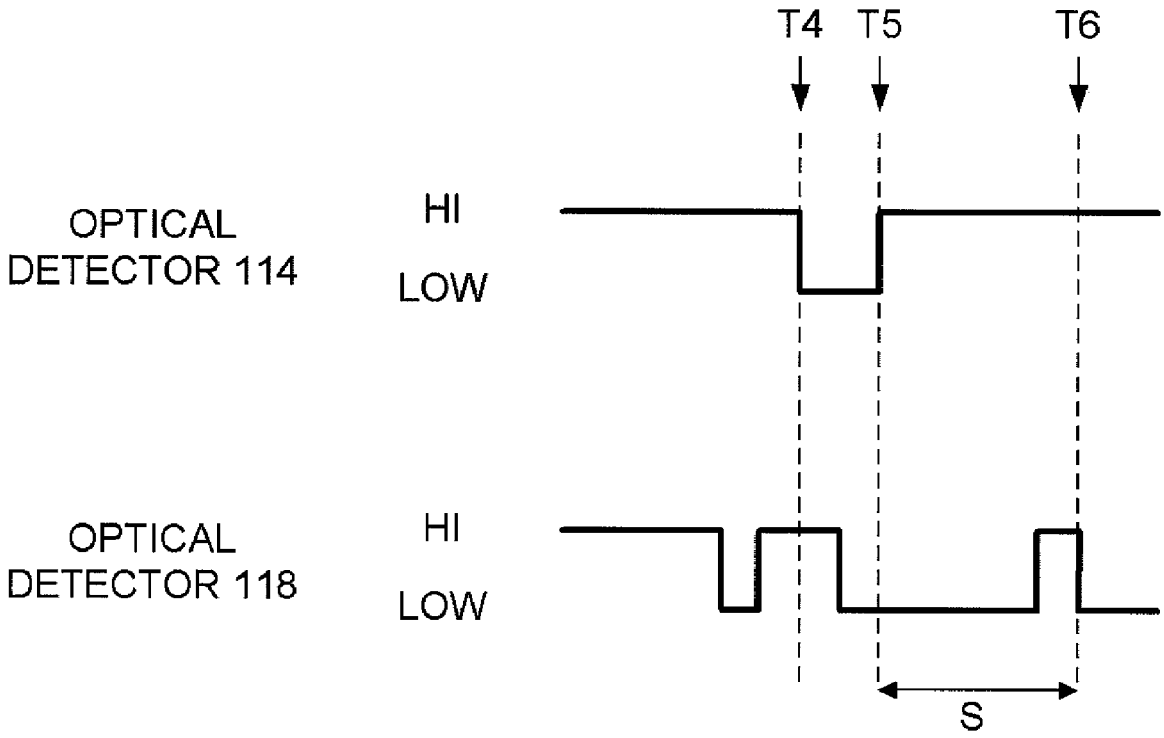
FIG. 13 is time profiles of output signals from two optical detectors caused by the ink cartridge of FIGS. 12(A) and 12(B).

Similarly to the embodiment described above, when the ink cartridge 30 is mounted to the cartridge holder 110, the triggering portion 85 enters and passes the detection area 115 of the optical detector 114 (See FIG. 13: T4, T5), and the type determinative portion 77 enters and passes the detection area 119 of the optical detector 118, and then the irradiated portion 34C of the ink amount detection portion 34 enter the detection areas 115, 119 of the optical detectors 114, 118 (FIG. 13: T6). Meanwhile, a front portion of the cover 32 with respect to the insertion direction 50 comes into contact with the end wall 117 of the cartridge holder 110.

As described above, in order for the ink amount detection portion 34 to enter the position corresponding to the window 33 of the cover 32, the case 31 is needed to be further moved in the insertion direction 50 after the front portion of the cover 32 comes into contact with the end wall 117 of the cartridge holder 110 until the case 31 and the cover 32 are positioned closest to each other. Accordingly, a time period S from a timing T5 when the optical detector 114 stops detecting the triggering portion 85 to a timing T6 when at least one of the optical detectors 114, 118 detect the light-blocking panel 62 is relatively increased (see FIG. 13).

Accordingly, even when the speed of insertion of the ink cartridge 30 into the cartridge holder 110 is increased, there is a certain time difference between the first determination and the second determination, and the determination of the mounted state of the ink cartridge 30, and therefore the respective determinations are performed reliably by the controller 90.

Moreover, the front portion of the case 31 is protected by the cover 32. In other words, breakage of the seal at the air communication opening 71, or breakage of the ink supply portion 72 or the ink amount detection portion 34 are prevented.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink supply device comprising:

a cartridge mounting portion to which an ink cartridge is configured to be mounted by being inserted thereinto in an insertion direction, wherein the cartridge mounting portion comprises:

a first detector configured to detect a first portion of the ink cartridge and to output first detection information when the first detector detects the first portion of the ink cartridge, and a second detector configured to detect a second portion of the ink cartridge and to output second detection information when the second detector detects the second portion of the ink cartridge;

a controller configured to store, in a storing unit, first determination information of whether or not the second detection information is output by the second detector when the first detector begins outputting the first detection information, and second determination information of whether or not the second detection information is output by the second detector when the first detector stops outputting the first detection information; and the controller is further configured to determine a type of the ink cartridge based on the first determination information initially stored during an insertion of the ink cartridge into the cartridge mounting portion and the second determination information finally stored during the insertion of the ink cartridge into the cartridge mounting portion.

2. The ink supply device of claim 1, further comprising a first determiner configured to determine whether a mounting of the ink cartridge to the cartridge mounting portion has been completed, wherein the controller determines the type of the ink cartridge when the first determiner determines that the mounting of the ink cartridge to the cartridge mounting portion has been completed.

3. The ink supply device of claim 1, further comprising a second determiner configured to determine whether the ink cartridge is being inserted into the cartridge mounting portion, wherein the controller determines, based on determination by the second determiner, the type of the ink cartridge based on the first determination information initially stored after the ink cartridge is started to be inserted into the cartridge mounting portion and the second determination information finally stored after the ink cartridge is started to be inserted into the cartridge mounting portion.

4. The ink supply device of claim 1, wherein the ink cartridge comprises a case configured to store in therein, and a cover configured to cover a front side of the case with respect to the insertion direction, wherein the cover is configured to slide on the case in the insertion direction, and wherein the cover comprises the first portion and the second portion.

5. The ink supply device of claim 1, wherein each of the first detector and the second detector comprises a light-receiving portion configured to receive light and a light-emitting portion configured to emit light toward the light-receiving portion, and the first detector and the second detector are configured to detect the first portion and the second portion, respectively, when a corresponding one of the first portion and the second portion intersects an optical path between the light-emitting portion and the light-receiving portion, causing an intensity of light received by the light-receiving portion to change.

6. The ink supply device of claim 5, wherein each of the first portion and the second is configured to adjust the intensity of light reaching the light-receiving portion of a corresponding one of the first detector and the second detector when intersecting the optical path of the corresponding one of the first detector and the second detector during the insertion of the ink cartridge into the cartridge mounting portion.

7. A method of determining a type of an ink cartridge in an ink supply device comprising a cartridge mounting portion to which the ink cartridge is configured to be mounted by being inserted thereinto in an insertion direction, wherein the cartridge mounting portion comprises a first detector configured to detect a first portion of the ink cartridge and to output first detection information when the first detector detects the first portion of the ink cartridge, and a second detector configured to detect a second portion of the ink cartridge and to output second detection information when the second detector detects the second portion of the ink cartridge, the method comprising the steps of:

storing first determination information of whether or not the second detection information is output by the second detector when the first detector begins outputting the first detection information;

storing second determination information of whether or not the second detection information is output by the second detector when the first detector stops outputting the first detection information; and determining a type of the ink cartridge based on the first determination information initially stored during an insertion of the ink cartridge into the cartridge mounting portion and the second determination information finally stored during the insertion of the ink cartridge into the cartridge mounting portion.

8. The method of claim 7, further comprising determining whether a mounting of the ink cartridge to the cartridge mounting portion has been completed, wherein the type of the ink cartridge is determined when the mounting of the ink cartridge to the cartridge mounting portion is determined to have been completed.

9. The method of claim 7, further comprising determining whether the ink cartridge is being inserted into the cartridge mounting portion, wherein, based on determination of whether the ink cartridge is being inserted into the cartridge mounting portion, the type of the ink cartridge is determined based on the first determination information initially stored after the ink cartridge is started to be inserted into the cartridge mounting portion and the second determination information finally stored after the ink cartridge is started to be inserted into the cartridge mounting portion.

10. The method of claim 7, wherein the ink cartridge comprises a case configured to store in therein, and a cover configured to cover a front side of the case with respect to the insertion direction, wherein the cover is configured to slide on the case in the insertion direction, and wherein the cover comprises the first portion and the second portion.

11. The method of claim 7, wherein each of the first detector and the second detector comprises a light-receiving portion configured to receive light and a light-emitting portion configured to emit light toward the light-receiving portion, and the first detector and the second detector are configured to detect the first portion and the second portion, respectively, when a corresponding one of the first portion and the second portion intersects an optical path between the light-emitting portion and the light-receiving portion, causing an intensity of light received by the light-receiving portion to change.

12. The method of claim 11, wherein each of the first portion and the second is configured to adjust the intensity of light reaching the light-receiving portion of a corresponding one of the first detector and the second detector when intersecting the optical path of the corresponding one of the first detector and the second detector during the insertion of the ink cartridge into the cartridge mounting portion.

* * * * *